US011079154B2

(12) United States Patent
Mor

(10) Patent No.: US 11,079,154 B2
(45) Date of Patent: Aug. 3, 2021

(54) DRY HARVESTING ICE MACHINE

(71) Applicant: ICEBOW LTD., Mazkeret Batya (IL)

(72) Inventor: Elad Mor, Mazkeret Batya (IL)

(73) Assignee: ICEBOW LTD., Mazkeret Batya (IL)

( * ) Notice: Subject to any disclaimer, the term of this patent is extended or adjusted under 35 U.S.C. 154(b) by 83 days.

(21) Appl. No.: 16/203,993

(22) Filed: Nov. 29, 2018

(65) Prior Publication Data

US 2019/0093934 A1 Mar. 28, 2019

Related U.S. Application Data

(63) Continuation-in-part of application No. PCT/IL2017/050883, filed on Aug. 9, 2017.

(60) Provisional application No. 62/593,268, filed on Dec. 1, 2017, provisional application No. 62/372,817, filed on Aug. 10, 2016, provisional application No. 62/446,902, filed on Jan. 17, 2017, provisional application No. 62/504,157, filed on May 10, 2017.

(51) Int. Cl.

| | |
|---|---|
| ***F25C 5/06*** | (2006.01) |
| ***F25C 1/04*** | (2018.01) |
| *F25C 1/12* | (2006.01) |

(52) U.S. Cl.

CPC ..... *F25C 5/06* (2013.01); *F25C 1/04* (2013.01); *F25C 1/12* (2013.01)

(58) Field of Classification Search

CPC ..... F25C 5/06; F25C 1/22; F25C 1/24; F25C 1/243; F25C 1/246; F25C 1/04; F25C 1/045; F25C 1/06; F25C 1/12

See application file for complete search history.

(56) References Cited

U.S. PATENT DOCUMENTS

| | | | | |
|---|---|---|---|---|
| 2,389,317 A * | 11/1945 | Kitto | F25C 1/24 | 62/73 |
| 2,770,102 A * | 11/1956 | Roedter | F25C 1/04 | 62/137 |
| 2,918,803 A * | 12/1959 | Bauerlein | F25C 1/04 | 62/135 |
| 3,388,560 A | 6/1968 | Moreland, II | | |

(Continued)

FOREIGN PATENT DOCUMENTS

| | | |
|---|---|---|
| CN | 102003858 A | 4/2011 |
| DE | 10260159 A1 | 7/2004 |

OTHER PUBLICATIONS

Manitowoc user guide, "S Model Air Water Remote Ice Machines", (2018), p. 151.

*Primary Examiner* — Andrew D Stclair

(74) *Attorney, Agent, or Firm* — The Roy Gross Law Firm, LLC; Roy Gross

(57) ABSTRACT

An ice machine, comprising a pressure source configured to provide a gas above ambient pressure. The ice machine comprises an evaporator grid comprising a evaporator back board and an elastic substrate disposed over the evaporator back board, configured to elastically contract in thickness towards the evaporator back board. The evaporator grid comprises a gas valve in fluid communication with the pressure source. The ice machine comprises one or more controllers configured to initiate separation between the elastic substrate and an ice block that is formed in the evaporator grid. The gas valve is configured to inject the gas into a space formed by the separation, where the gas has a pressure above ambient pressure.

17 Claims, 39 Drawing Sheets

(56) References Cited

U.S. PATENT DOCUMENTS

| | | | | | |
|---|---|---|---|---|---|
| 3,707,080 | A * | 12/1972 | Moreland, II | F25C 1/24 | 62/233 |
| 3,739,595 | A * | 6/1973 | Learn | F25C 1/125 | 62/135 |
| 4,412,429 | A | 11/1983 | Kohl | | |
| 4,782,835 | A * | 11/1988 | Bernardini | A47J 27/004 | 607/114 |
| 4,843,827 | A * | 7/1989 | Peppers | F25C 1/12 | 62/73 |
| 4,990,169 | A * | 2/1991 | Broadbent | F25C 1/125 | 426/250 |
| 5,329,780 | A | 7/1994 | Broadbent | | |
| 6,357,720 | B1 * | 3/2002 | Shapiro | F25C 1/10 | 249/119 |
| 6,681,580 | B2 | 1/2004 | Shedivy et al. | | |
| 2003/0046942 | A1 * | 3/2003 | Shedivy | F25C 1/12 | 62/71 |
| 2013/0014535 | A1 | 1/2013 | Son et al. | | |
| 2020/0033042 | A1 * | 1/2020 | Junge | F25C 1/22 | |

* cited by examiner

DRY HARVESTING ICE MACHINE

CROSS REFERENCE TO RELATED APPLICATIONS

This application is a Continuation In Part (CIP) of PCT patent application No. PCT/IL2017/050883, filed Aug. 9, 2017, which claims priority from U.S. Provisional Patent Application No. 62/372,817, filed Aug. 10, 2016, entitled "Dry Harvesting for Ice Cube Makers", U.S. Provisional Patent Application No. 62/446,902, filed Jan. 17, 2017, entitled "Dry Harvesting Components for Ice Machines", and U.S. Provisional Patent Application No. 62/504,157, filed May 10, 2017, entitled "Ice Supporting Plate for Dry Harvesting Ice Machines".

This application also claims the benefit of priority from U.S. Provisional Patent Application No. 62/593,268, filed Dec. 1, 2017, entitled "Ice Maker Assembly with Dry Harvesting" which are all incorporated herein by reference in their entirety.

FIELD OF THE INVENTION

The invention relates to the field of ice making machines and more particularly, but not exclusively, to dry harvesting ice making machines.

BACKGROUND

Ice making machines may make ice in different forms, such as cubes, tubes, plates, flakes, and/or the like. Many machines operate in batches and use wet ejecting to remove the ice after being formed on an evaporation surface. During wet ejecting, the evaporation surface is heated, possibly using the refrigeration elements operated in reverse, and the ice adjacent to the surface melts to release the ice slab, plate, batch, tube, and/or the like. The ejected ice drops into a collection bin, and ice tube machines will chop the long tubes of ice into smaller pieces. Ice cube machines may be typically used in restaurants, hotels, and/or the like, while ice tube and plate machines may be used for commercial ice production, such as bags of ice distributed to supermarket chains, ice for fisheries, and/or the like.

The foregoing examples of the related art and limitations related therewith are intended to be illustrative and not exclusive. Other limitations of the related art will become apparent to those of skill in the art upon a reading of the specification and a study of the figures.

SUMMARY

The following embodiments and aspects thereof are described and illustrated in conjunction with systems, tools and methods which are meant to be exemplary and illustrative, not limiting in scope.

There is provided, in accordance with an embodiment, an ice machine, comprising a pressure source configured to provide a gas at a pressure above ambient pressure and an evaporator grid. The evaporator grid comprises an evaporator back board (e.g. evaporator back board, can be made from high conductive polymer, combination of metal and polymer, metal, etc.) and an elastic substrate disposed over the evaporator back board, configured to elastically contract in thickness towards the evaporator back board by at least 10 micrometers. The evaporator grid comprises a gas valve in fluid communication with the pressure source. The gas valve is configured to initiate separation between the elastic substrate and an ice block that is formed in the evaporator grid. The ice machine comprises one or more controllers configured to inject the gas into a space formed by the separation, where the gas has a pressure above ambient pressure.

In some embodiments, the evaporator grid further comprises an ice seal mechanism along the periphery of the evaporator back board, where the ice seal mechanism is configured to prevent escape of the gas until the ice is mostly detached from the elastic substrate and configured for ejecting the ice into a dispenser thereafter. In some embodiments, ice seal mechanism comprises one or more of: an angled metallic surface, where the angled metallic surface is substantially rigid; a groove; a rigid area of the elastic substrate; a heating element; a mechanical lever; a compressible cushion disposed within a groove; and a removeable seal frame.

In some embodiments, the gas valve comprises a gas outlet notch and one or more of: an expandable cushion in mechanical communication with the gas outlet notch; a central pin configured to seal the gas outlet notch when ice is formed in the evaporator grid; a piston connected to one edge of the gas outlet notch, and configured to slide away from the gas outlet notch when the gas is applied; and a central pin configured to slide out of the gas valve towards the ice block and assist in ejecting the ice block. In some embodiments, the evaporator back board comprises a plurality of voids for receiving at least part of the elastic substrate when the elastic substrate is elastically contracted.

In some embodiments, the elastic substrate comprises a plurality of flexible regions, one or more flexible regions along each corner of the elastic substrate. In some embodiments, the ice block comprises a plurality of ice cubes and the ice machine is an ice cube machine.

In some embodiments, the ice block comprises one or more ice tubes, the evaporator grid is an array of evaporator tubes, and the ice machine is a tube ice machine. In some embodiments, the ice block comprises one or more ice plates, and the ice machine is a plate ice machine.

In some embodiments, the gas is at ambient pressure at least 0.1 bar above ambient pressure.

In some embodiments, the gas is at ambient pressure and the evaporator grid is held at a pressure below ambient pressure by at least 0.1 bar using a fluid connection to a suction pump.

In some embodiments, the ice machine further comprises a rigid ice support plate opposing the elastic substrate for preventing a bending of the ice slab during ejection. In some embodiments, the rigid ice support plate comprises elevated ridges.

In some embodiments, the ice machine further comprises a splash prevention plate, and wherein the rigid ice support plate is incorporated into the splash prevention plate.

In some embodiments, the ice machine comprises a splash prevention plate, and wherein the rigid ice support plate is connected to the splash prevention plate.

There is provided, in accordance with an embodiment, a method for ejecting ice from an ice machine comprising using one or more controller configured for commanding the actions of inserting a gas into a gas valve connected to an evaporator back board of an evaporator grid, where the gas is at a pressure least 0.1 bar above ambient pressure. The controller(s) are configured for an action of initiating separation between an ice block and an elastic substrate in a region surrounding the gas valve by mechanical manipulation of an outlet notch of the gas valve, where the elastic substrate is disposed over the evaporator back board. The controller(s) are configured for an action of expanding separation between the ice block and the elastic substrate by contraction of the elastic substrate towards the evaporator back board by at least 10 micrometers until most of the ice block is separated from the elastic substrate.

In some embodiments, the method further comprises an action of applying a force directed at least in part towards elastic substrate during the separation of the ice block, and further comprises an action of releasing the force during the ejection of the ice block.

In some embodiments, the method further comprises an action of ejecting the ice block from the evaporator grid by: breaking a seal between the ice block and evaporator grid surrounding the periphery of the elastic substrate and applying an ejection force on the ice block in the direction of an ice dispenser.

In some embodiments, the seal is created during formation of the ice block on an angled metallic surface, where the angled metallic surface is substantially rigid. In some embodiments, the seal is created during formation of the ice block in a groove. In some embodiments, the breaking of the seal comprises one or more actions from: activating a heating element; operating a mechanical lever; expanding a compressible cushion disposed within a groove; and moving a removeable seal frame.

In some embodiments, the ejection force is applied by the action of sliding a central pin out of the gas valve towards the ice block to assist in ejecting the ice block. In some embodiments, the initiating separation comprises an action of a release of the gas from the outlet notch and one or more actions from: expanding a valve cushion in mechanical communication with the gas outlet notch; moving a central pin configured to seal the gas outlet notch when ice is formed in the evaporator grid; sliding a piston connected to one edge of the gas outlet notch in a direction away from the gas outlet notch when the gas is applied; heating the ice surrounding the valve; and leaking a low-pressure gas into the water prior to ice formation.

In some embodiments, the contraction of the elastic substrate is assisted be at least part of the elastic substrate compressing into a plurality of voids in the evaporator back board.

In some embodiments, the gas passes corners in the elastic substrate at a plurality of flexible regions, one or more flexible regions along each corner of the elastic substrate.

In some embodiments, the gas is at ambient pressure and the evaporator grid is held at a pressure below ambient pressure by at least 0.1 bar using a fluid connection to a suction pump.

In some embodiments, the gas is at a pressure above ambient pressure by at least 0.1 bar.

In some embodiments, the contraction of the elastic substrate towards the evaporator back board is by at least 10 micrometers.

In some embodiments, the contraction of the elastic substrate towards the evaporator back board continues until most of the ice block is separated from the elastic substrate.

In addition to the exemplary aspects and embodiments described above, further aspects and embodiments will become apparent by reference to the figures and by study of the following detailed description.

BRIEF DESCRIPTION OF THE FIGURES

Exemplary embodiments are illustrated in referenced figures. Dimensions of components and features shown in the figures are generally chosen for convenience and clarity of presentation and are not necessarily shown to scale. The figures are listed below.

DETAILED DESCRIPTION

Figure 1:
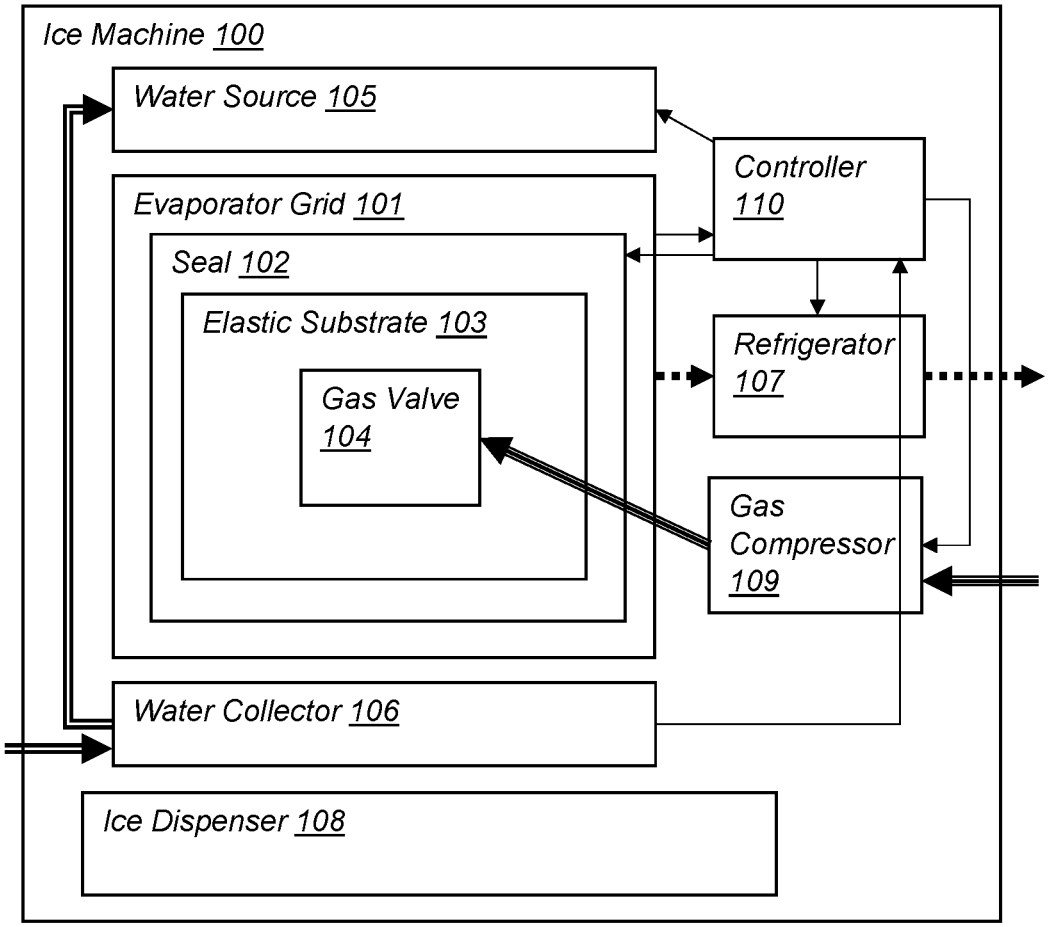
FIG. 1 is a schematic illustration of an ice machine with dry harvesting.

Described herein are methods and devices for dry ejection of ice blocks, slabs, tubes, and/or the like in ice machines. Dry ejection of ice blocks may be performed with a valve configured to inject compressed fluid in between the ice and an evaporator grid, where the evaporator grid comprises a back board (i.e. with high thermal conductivity) and an elastic substrate. The fluid may be the ambient gas, such as air, a processed gas, a liquid, such as water, and/or the like, and the term gas and/or air as used herein may mean any fluid suitable and/or capable of separating between the ice plate and the grid. For example, this gas has a lower density than the ambient atmosphere. The valve may also be configured to be at least partially flexible and/or elastic and initiate a crack between the ice and the grid when the compressed gas is applied to the valve. The grid may be covered with one or more elastic substrate materials, that may allow the substrate to move away from the ice, such as contract in thickness, by the motion of the compressed gas. Special regions of flexibility are configured around corners so that the compressed gas passes to most locations between the ice and the grid.

A special region around the perimeter of the ice grid may form a seal for the compressed gas to remain between the ice and grid without leaking out from the edges of the grid. For example, an ice gasket groove fills with water that freezes to ice thus forming a seal. Once the ice and grid are mostly detached, the ice is ejected by releasing the seal around the perimeter of the ice. These stages of the dry ejecting may be referred to as a separation initiation, an ice detachment, and an ice ejection. Dry ejection may be used with ice cube machines with horizontal or vertical evaporator, ice tube machines, ice plate machines, and/or the like.

As used herein, the term "valve" means an orifice in the evaporator grid for injecting compressed air between the grid and one or more blocks of ice formed on the grid. The valve may be a simple hole, a slit, a hole with some flexible parts to initiate separation between the ice block(s) and the grid, a hole with a mechanical element for facilitating the ejection of the ice after separation, and/or the like. The valve may operate under positive or negative pressure relative to the ambient pressure. For example, the valve may have a slit that prevents water from entering the valve and forming ice. A flexible region of the valve at least in part surrounding the slit, will deform by the application of a compressed gas on within the valve so that at least some of the flexible region will separate from the ice block and allow the compressed gas to pass between the ice block and the elastic substrate. Optionally, flexible region and/or components within the valve may assist in the initial separation of the ice from the elastic substrate.

For the grid to have an elastic substrate while retaining good thermal conductivity to form the ice, the grid may comprise two or more different materials, such as (i) a base material with good thermal conductivity, and (ii) an ice forming substrate. The base material of the grid may be a material of high thermal conductivity, for example between 2 and 400 watt-meter per degree kelvin (Wm/K), that may be very rigid, such as metal alloys comprising copper, zinc, aluminium, and/or the like. An elastic heat conducting substrate made of flexible heat conducting material covers the base material, such as an evaporator back board, so that the ice is formed on the elastic substrate. For example, the elastic substrate, has a Shore hardness (OO scale) with values between 10 and 90, such as a gel material, paste, a rubber material, a synthetic viscoelastic urethane polymer (Sorbothane®) material, and/or the like, and may be composed from number of materials with different Shore hardness, as well. Examples for elastic substrate are the thermal interface materials (TIMs) consists of a polymerizable matrix and large volume fractions of thermally conductive filler. Typical matrix materials are epoxies, silicones, urethanes, and acrylates, solvent-based systems, hot-melt adhesives, and/or the like. Aluminium oxide, boron nitride, zinc oxide, aluminium nitride and/or the like are used as fillers for these types of materials.

Between the substrate and the grid, a series of voids may be filled with gas and/or air and positioned on the grid so that the elastic substrate, which may be an incompressible material, can expand into the voids when the compressed gas passes between the ice and the substrate. Thereby, the elastic substrate may contract in thickness by at least 10 micrometers, and thus separate from the ice. For example, the elastic material contracts between 5 micrometers and 5 millimeters. Optionally, the elastic substrate comprises gas voids, such as air bubbles, micro bubbles, and/or the like, that contract during the passing of the compressed gas and allow the elastic flexibility of the substrate. The elastic heat conduction substrate may further comprise a thin outer layer of high-deflection, stiff, flexible material, such as a food-safe metal, on the side where the ice blocks are formed to provide mechanical support for the flexible substrate.

The stiff outer layer may help to:

return the elastic heat conduction substrate to its original size and shape when the gas pressure is removed, durability for the grid, food and drug administration (FDA) compliance, hydrophobic properties, hydrophilic properties, and/or the like.

For example, hard steel, hard stainless steel, spring steel, metal alloys comprising phosphorus bronze, nickel, cobalt, brass and/or the like, may be used as a stiff outer layer of the elastic substrate.

The outer layer may include of specific food safe material coating, having for example, a 'hydrophobic texture' or a 'hydrophilic texture', composed from millimeter (mm), micrometer (micron), or sub-micron size elements, which may be periodic, quasi-periodic or disorderly. For example, geometric structures may be composed of pillars, conical shapes, spherical shapes, a series of geometric structures, combinations of shapes, protrusions, niches, and/or the like. Textures may be made using combinations of hot embossing techniques, imprint techniques, etching process, layer by layer depositions, and/or the like. These textures may serve as micro air tunnels, during motion of the compressed gas.

The elastic substrate may be connected to the grid and/or evaporator by gluing, adhesives, compression springs, compression bolts, bolts, rivets, compression rivets, springs, spot welding, ultrasonic welding, cold welding, and/or the like. The outer layer may be manufactured and/or connected to the elastic substrate, either entirely or in parts, by stamping, folded, pressed, milled, deep drawing, with a polymer by injection overmolding, and/or the like.

The stage of separation initiation is the formation of a crack between the ice and grid around the valve, and the valve can take an active of passive part in the crack formation, such as the initial separation between the ice and the substrate. The stage of ice detachment is facilitated by the elastic substrate this is flexible enough to displace, such as displace between a few micrometres up to tens of micrometers from the ice, where the voids allow for this displacement. For example, the elastic substrate thickness is between 5 micrometers and 4 mm thick, and the substrate displaces between 3 micrometers and 500 micrometers from the ice. A thin elastic substrate may allow using a material with relatively high thermal conductivity, such as 17 Wm/K.

The stage of ice ejection is facilitated by the releases of a seal surrounding the ice. The seal may also assist in ice detachment by keeping the pressure between the ice and substrate high, for example relative to the ambient pressure, so that the ice is completely detached before being ejected. There exist multiple embodiments for the valve's function in separation initiation. There exist multiple embodiments for the substrate's and seal's function in ice detachment. There exist multiple embodiments for the seal's function in ice ejection. Each of these embodiments also includes changes to the valve, substrate, and seal, and thus these three aspects may be implemented differently in multiple embodiments, where the functions may be similar.

Optionally, the edges and/or corners of a grid in an ice cube machine comprise more flexible regions to allow the elastic heat conducting substrate to pass the compressed gas around the corners. For example, each edge of the substrate that defines a corner of between two faces of an ice cube and/or the grid has a region where the substrate is slightly thicker, a local void, and/or the like, to give some additional flexibility over the rest of the elastic substrate. For example, a metal layer covering the flexible material has a hole, a slit, and/or the like. Optionally, ice cube machines have a grid with draft angles in each cube of the grid for easy ejection of an ice block, such as a plate of connected ice cubes.

Optionally, the compressed gas is compressed air. For example, a compressed gas may be air, $CO_2$ gas, and/or the like.

Optionally, the compressed gas is at ambient pressure while the pressure in and around the evaporator grid is below ambient pressure. For example, a suction pump is applied to the evaporator grid and surrounding regions of the ice machine, lowering the pressuring in the voids at least 0.1 bar below the ambient pressure, and the compressed gas entering the valve is ambient pressure gas, such as high-pressure gas. The term high-pressure gas means a gas that is at a pressure above the pressure of the voids in the evaporator grid. For example, when the voids are in fluid connection with a suction pump, the voids may have a pressure 0.1 bar below the ambient pressure and up to 5 bar below the ambient pressure.

Optionally, the grid voids are at least partially interconnected. For example, two or more voids are connected by channels that allow the conversion of pressure at one point between the ice and the grid, such as a first void, to a mechanical force at a second point between the ice and the grid, such as a second void. This interconnection may facilitate the propagation of the compressed gas by further applying mechanical forces to regions where the ice and grid are still firmly attached. For example, the interconnecting channels allow conversion of pressure at a first void to a shear stress of the elastic substrate at another location along the grid.

Optionally, the valve comprises a pin to facilitate the crack initiation or the ice ejection. For example, the pin extends, such as with a mushroom shape, over the gas valve so that ice cannot form on the gas outlet from the valve. For example, the pin is configured to move in the direction of the ice to force the ice to eject from the grid. For example, compressed gas at a pressure of 0.3 bar above (or below in the case of a negative pressure embodiment) ambient/atmospheric pressure (AP), such as 4.35 pounds per square inch above AP, is introduced into the valve, and the flexible walls of the valve expand away from the valve's center, causing the gas outlet to peel away from the adjacent ice cube filling the grid. This may allow the compressed gas to pass between the ice cube and the grid on a first face of the ice cube and reach the edges of the first face. When the compressed gas reaches a flexible region along the edges, the compressed gas passes the corner onto the next face of the ice cube. Similarly, the compressed gas passes over the top of the grid to the next ice cube, and thus releases all the ice cubes from the grid. The seal around the grid is now holding the tray of ice cubes to the grid, and by releasing the seal, such as moving a mechanical element, increasing (or decreasing in the case of a negative pressure embodiment) the pressure to an ejection pressure value, such as 0.5 bar above AP, operating a heating element, and/or the like, operating a heating element, and/or the like, the ice cube plate, as in one batch, is ejected from the grid. Optionally, a heating element near the ice seal is heated incrementally until the ice that forms the seal is melted and the ice is ejected. Optionally, both the seal is heated, and the pressure is increased (or decreased in the case of a negative pressure embodiment) incrementally until the ice is ejected. Optionally, the hot refrigerator gasses are used to heat the seal.

Optionally, part of the seal or any other part from the ice block is left on the grid, in order to facilitate ice nucleation on the ejected grid, thereby reducing the water super-cooling temperature and energy losses, in the beginning of the next freezing process. The compressed gas passes between the ice and the grid in part because of the pressure difference between the gas in the voids and the gas in the valve. Once this pressure difference is above a value, such as 0.3 bar, the crack will initiate and propagate until the ice is detached from the grid. This can be done by injecting compressed gas into the valve, or by decompressing the gas in the voids and surrounding the valve. For example, the compressed gas is at a pressure of 0.35 bar above (or below in the case of a negative pressure embodiment) the ambient pressure. For example, the gas pressure in the voids and surrounding the valve is 0.3 bar below AP, such as negative pressure.

Optionally, the seal is heated to melt the ice forming the seal and thus eject the ice cube plate.

Optionally, some gas pressure is applied during the formation of the ice cubes to prevent ice from forming directly over the valve gas outlet hole.

In wet ice ejection, the grid is heated until the ice plate or tube falls out of the grid, optionally chopped, and into a dispenser. This heating is both time consuming and requires energy to force heat back into the grid for ejecting the ice. By dry ejecting the ice, both the time for ejection can be shortened relative to wet ejection, and the energy for heating the grid can be saved. Thus, the benefits dry ejecting in ice machines are substantial. The aspects described herein have the benefit of no moving parts in separating between the ice and the grid, and thus are robust and easy to maintain. The aspects described herein are capable of separating ice cubes two or more faces of the ice cube (such as up to all 5 faces of a brick shaped ice cube). Additional configurations of ice cube shapes may benefit from the aspects described herein, such as a variety of faces of ice "cubes" with different cross-sectional shapes, such as star shaped ice cubes, heart shaped ice cubes, as produced in Hoshizaki ice machines, and the like. For example, the elastic substrate and valve may be connected to any evaporator grid and may be incorporated into existing ice machines with only a few simple changes to the machines. Since the volume of air that is needed to separate the ice is small, such as up to 100 centiliters, the air pump that needs to be added to existing machines is small and can be pre-pressurized before the ejection.

Following is a table of operational benefits to ice machines (such as an Ice-o-Matic® model ICE0605FA-5 ice machine) using dry ejection according to aspects described herein, with units of kilowatt (KW) and KW-hour (KWh):

TABLE 1

| Parameter | Wet Eject | Dry Eject | Units | % benefit |
|---|---|---|---|---|
| Cycle period | 19.00 | 13.90 | Minutes | −27% |
| Weight per cycle | 2.40 | 2.40 | Kg | 0% |
| Production rate | 7.58 | 10.36 | Kg/h | 37% |
| Avg. power | 0.90 | 0.91 | KW | 1% |
| Air pump power | 0.00 | 0.0017 | KW | 0% |
| Energy per cycle | 0.29 | 0.21 | KWh | −26% |
| | 0.12 | 0.09 | KWh/Kg | −26% |
| | 5.40 | 4.02 | KWh/100 lb | −26% |

Following is a table of operational benefits to residential refrigerator ice maker, with ice mold with 8 ice cubes mold, 17.5 cc each (such as Whirlpool Kenmore Ice Machine Ice Maker Mold and Heater W10190929):

TABLE 2

| Parameter | Wet Eject | Dry Eject | Units | % benefit |
|---|---|---|---|---|
| Water cooling | 4.06 | 4.06 | Watt hour | |
| Water freezing | 12.99 | 12.99 | Watt hour | |
| Ice cooling | 1.46 | 1.46 | Watt hour | |
| Ice melting | 13.88 | 0 | Watt hour | |
| Ice cooling in the storage bin | 1.32 | 0 | Watt hour | |
| Unused heat energy that was not absorbed in the ice during wet harvesting | 11.11 | 0 | Watt hour | |
| Total heat energy | 44.83 | 18.52 | Watt hour | −59% |

According to an aspect of some embodiments of the invention, there is provided an ice maker comprising an individual gas valve corresponding to a grid recess. The individual gas valves corresponding with individual grid recesses enable the harvesting of independent ice cubes. In some embodiments, the independent harvesting of the ice blocks enables the grid recesses to be separate from one another, which allows the evacuation of latent heat given off from the water during the freezing process, therefor increasing potential production rate of the ice blocks.

According to an aspect of some embodiments of the invention, there is provided an ice maker comprising at least one water channel. The water channels allow water to flow from the water source of the ice maker and into the grid. In some embodiments, the water channels distribute the water evenly between the recesses of the grid. In some embodiments, individual water channels feed water into individual grid recesses. In some embodiments, the water channels constrict water from flowing into areas which do not require water flow. In some embodiments, the grid rotates about a tilt axis which enables the control of water flow through the water channels.

In some embodiments, the ice maker includes the elastic substrate to replace the evaporator or the ice mold, which can be made from thin metal sheet having high heat conduction only in the normal direction to the substrate. In some embodiments, the elastic substrate is made from a polymer, such as but not limited to, elastomers, silicone rubber, and EPDM.

In some embodiments, compressed gas is used to break the vacuum behind an ice block. In some embodiments, the compressed gas is used to gradually device the ice from the elastic substrate, by applying compression stress on the ice, which generates low strain and low strain rate on the ice. As a result, the ice after applying the dry harvesting process using compressed gas, remains complete without any breakages. Furthermore, the deicing with compressed gas enables to harvest the ice cubes before the freezing process ends, by harvesting ice shells that are still filled with unfrozen water inside the shells, without breaking the thin shells and by ejecting the ice to the frozen storage bin to complete the freezing process or by keeping the ice shells in another location, such as a shelf, until they freeze completely before ejecting them to the storage bin. This capability contributes to the increase in production rate of the ice maker.

According to an aspect of some embodiments of the invention, there is provided an ice maker comprising at least one conduit. In some embodiments, the conduit is integrated in the grid of the ice maker. In some embodiments, the air in the conduit gets heated by latent heat from the freezing process of the liquid in the ice maker. In some embodiments, the conduit evacuates heat from the grid. The evacuation of the latent heat prevents it from heating the ice that has formed, and therefore speeds up the freezing process. Increasing the freezing time of the ice allows for faster harvesting of ice blocks, and therefore contributes to the increase of productivity of the ice maker, as well as improving the temperature uniformity along the tray.

According to an aspect of some embodiments of the invention, there is provided an ice maker comprising a tilting axis configured to change the potential energy of the ice block. In some embodiments, the axis of rotation is used to tilt the grid to obtain a desired tilting angle, and in some embodiments the axis of rotation is used to knock the back of the gird onto a subject in order to release the ice blocks from the grid. In some embodiments, the axis of rotation is used to rotate an ejector, which pushes the ice blocks in a circular motion and away from the grid.

3. According to an aspect of some embodiments of the invention, there is provided an ice maker comprising at least one lid. In some embodiments, the lid covers the grid recesses in which ice blocks are made. In some embodiments, the lid trap water in the grid recesses during the tiling of the grid about its rotation axis. In some embodiments, the range of rotation is between 0 and 180 degrees. In some embodiments, the range of rotation is between 30 and 150 degrees. In some embodiments, the range of rotation is between 45 and 90 degrees. In some embodiments, the range of motion of the rotation axis is at least 8 degrees.

According to an aspect of some embodiments of the invention, there is provided a method for distributing water.

In some embodiments, the method comprises flowing water from a water source and into a grid using the water channels. In some embodiments, the method comprises tilting the grid to increase water flow. In some embodiments, the method comprises tilting the grid from a horizontal position to a tilting angle to empty the channels from water and tilting the grid back into the horizontal position to prevent ice formation inside the channels.

According to an aspect of some embodiments of the invention, there is provided a method for ejecting ice from a rotating grid. In some embodiments, the method comprises changing the pressure between the elastic substrate and the grid. In some embodiments, the method comprises tilting the grid about its axis of rotation. In some embodiments, the method comprises allowing the formed ice blocks to leave the grid.

According to an aspect of some embodiments of the invention, there is provided a method for ejecting ice using a rotating ejector. In some embodiments, the ejector is a barrier. In some embodiments, the ejector rotates about an axis of rotation. In some embodiments, the method comprises placing an ejector onto a portion of an ice block. In some embodiments, the method comprises pushing the ice block by rotation of the ejector about an axis of rotation. In some embodiments, the method comprises allowing the ice block to leave the grid.

Following are example illustrations of aspects of certain embodiments.

Reference is now made to FIG. 1, which is a schematic illustration of an ice machine 100 with dry harvesting. Ice machine 100 comprises a water source 105 configured to flow water over an evaporator grid 101, such as an ice cube grid, an ice plate grid, an ice tube grid, and/or the like. The term grid means the heat conducting surface, such as an evaporator back board, over which ice is formed by flowing water on one side and thermally connecting a refrigerant to the grid to remove heat from the water and form ice. A water collector 106 collects water that did not freeze on grid 101 and the water is returned to source 105. Source 105 is also connected to an external water supply. A refrigerator 107 is thermally connected to the grid and removes heat from the water to form ice. Once the ice plate, tube or the like is formed, a gas compressor 109 supplies compressed gas to a gas valve 104, which initiates a separation of the ice from an elastic substrate 103 of the grid.

As used herein, the term batch means a quantity of ice formed on the grid, such as a plate, a tube, a series of connected ice cubes, and/or the like. Once the ice batch is separated from the substrate, a seal 102 is activated to release the ice batch from grid 101, and the ice batch drops into an ice dispenser 108. The control operation of water source 105, refrigerator 107, seal 102, and gas compressor 109 is performed by one or more electronic controllers 110 based on sensors connected to grid 101 and water collector 106. Optionally, electronic controller 110 is a computerized controller. Optionally, water for filling water collector 106 flows at least in part along a side of the evaporator during dry harvesting, thereby cooling the new water and further improving the ice machine efficiency.

For example, the at least one controller is an embedded controller, a computerized device, a computer, a server, and/or the like. A controller is configured by firmware, hardware, software, and the like, to control, command, monitor, perform, and/or the like. Software, such as program code, may be configured in modules and stored on a non-transitory storage medium accessible by the controller. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a wave-guide or other transmission media (e.g., light pulses passing through a fiber-optic cable), or electrical signals transmitted through a wire. Rather, the computer readable storage medium is non-transient (also "non-volatile").

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

Figure 2:
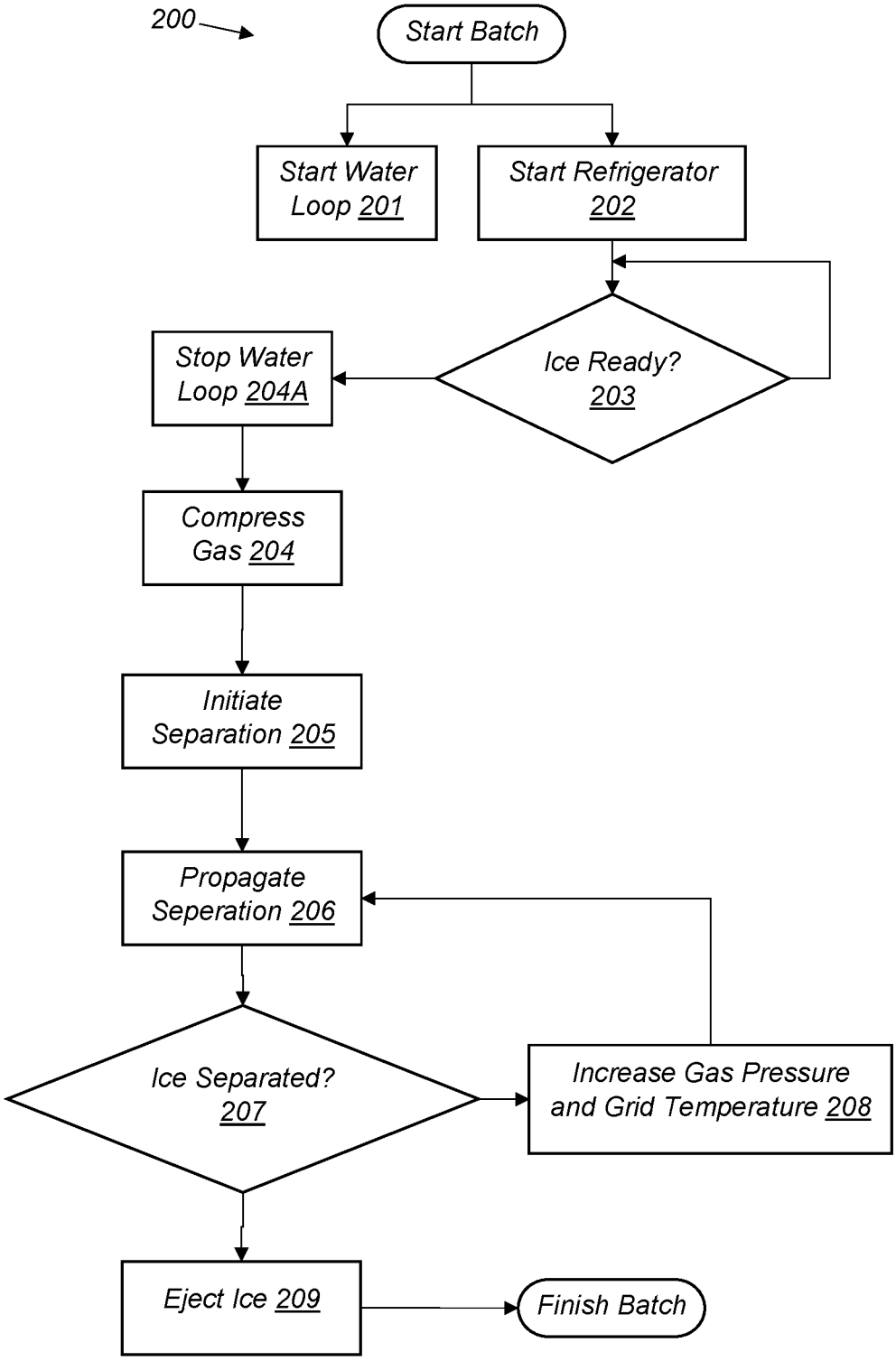
FIG. 2 is a flowchart of a method for dry harvesting of ice.

Reference is not made to FIG. 2, which is a flowchart 200 of a method for dry harvesting of ice. When a batch is started, the water loop is started 201 and the refrigerator is started 202. When the ice is ready 203, the water loop is stopped 204A and the gas is compressed 204. The compressed gas initiates 205 a separation of the ice from the substrate surrounding the valve, and the separation is propagated 206 throughout the evaporator grid by the compressed gas and elastic substrate. Ohmmeter sensor may be connected between the elastic substrate 103 and the seal 102, in order to measure the electric resistance during separation propagation 206, for example, when the gas 109 is insulated from the ice. When the ice hasn't separated 207 the gas pressure and grid temperature are incrementally increased 208 until the ice is separated from the substrate. When the ice is separated, the ice batch is ejected 209 such as by operation of a seal, increasing (or decreasing in the case of a negative pressure embodiment) a gas pressure, operating a seal heater, and/or the like. Optionally, a gas pressure is reduced to eject the ice batch.

Figure 3:
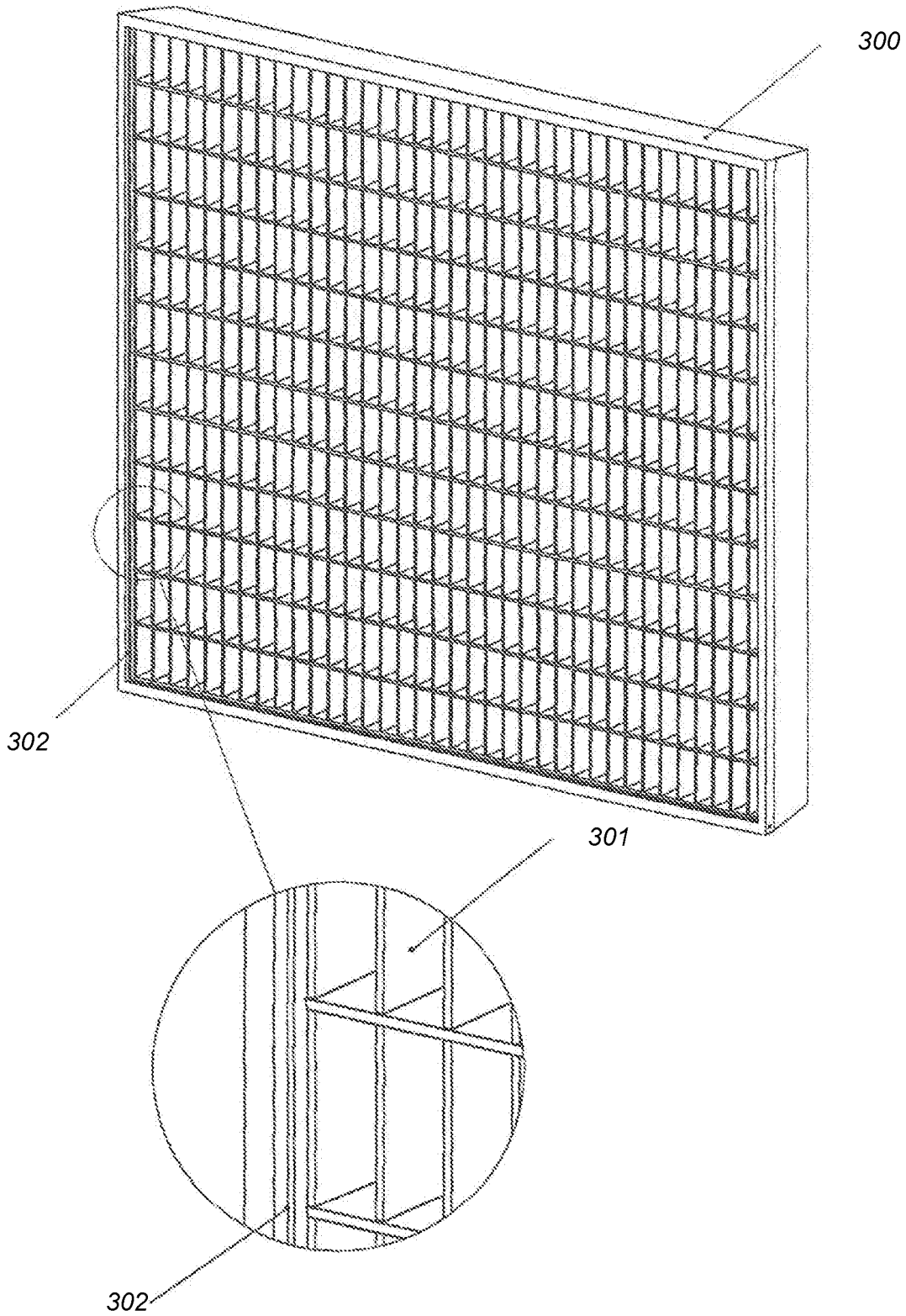
FIG. 3 is a schematic illustration of an evaporator grid for dry harvesting of ice.

Reference is not made to FIG. 3, which is a schematic illustration of an evaporator grid 300 for dry harvesting of ice. Grid 300 has an array of ice cube forming recesses 301 and a groove 302 for forming a seal.

Figure 4:
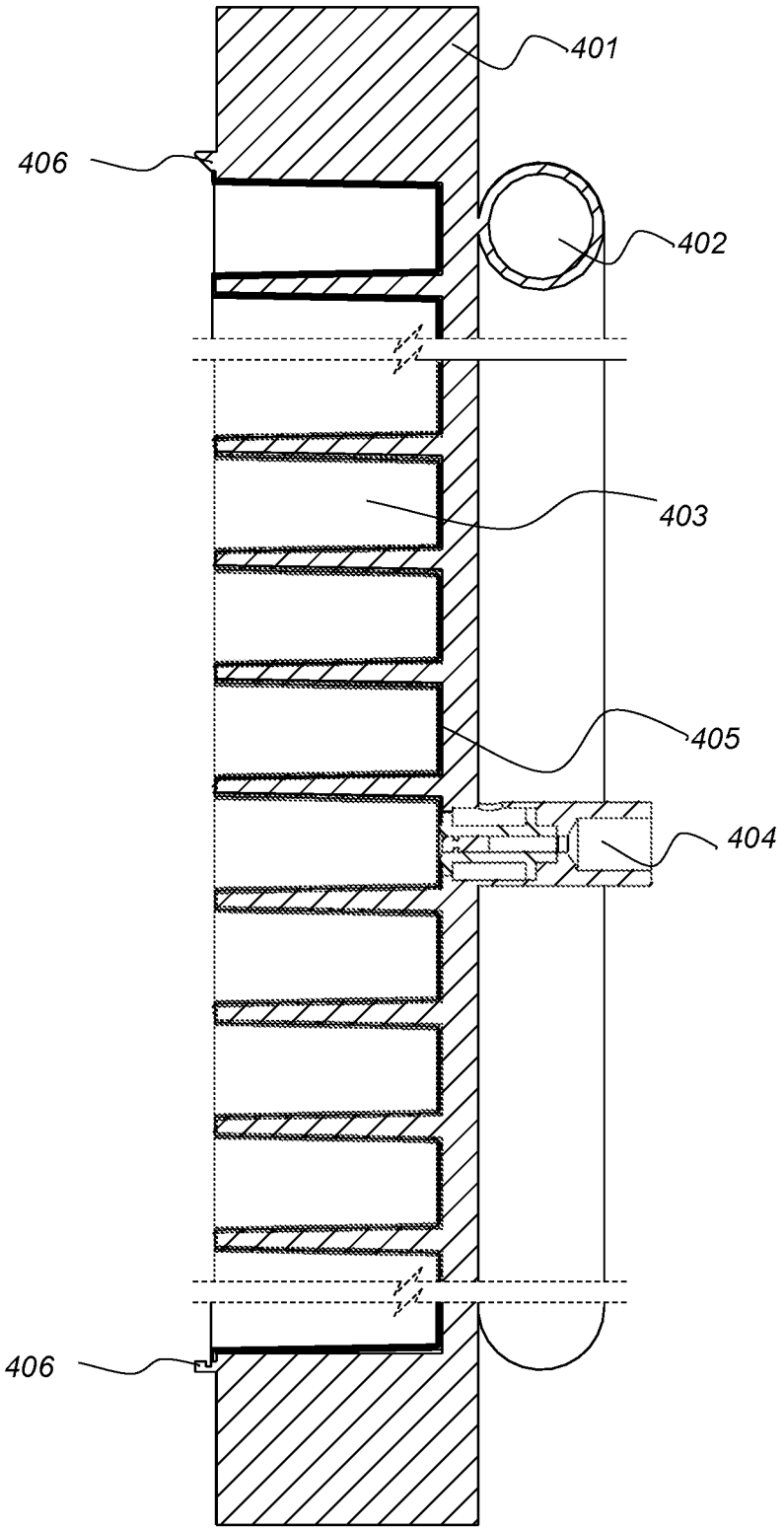
FIG. 4 is a cross section diagram of an evaporator grid for dry harvesting of ice.

Reference is not made to FIG. 4, which is a cross section diagram of an evaporator grid 401 for dry harvesting of ice. Grid 401 comprises a refrigerator heat exchanger 402 for drawing away heat from the water to form the ice cubes in grid 401, such as by using an evaporator back board. When ice is fully formed, gas valve 404 initiates the separation of the ice from grid 401 and passes compressed gas between the ice and substrate 405. Once ice is separated from substrate 405, a seal 406A or 406B is broken to eject the ice from the grid.

Figure 5:
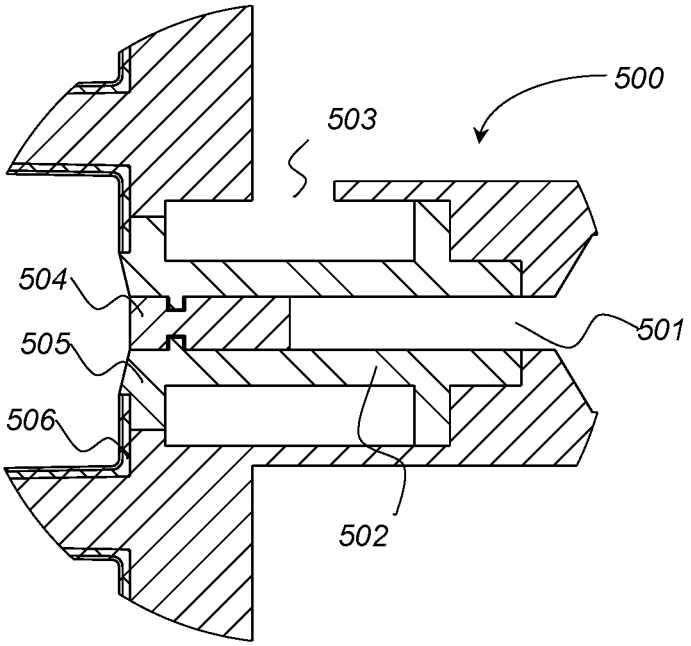
FIG. 5 are cross section diagrams of a compressed gas valve for dry harvesting of ice.
Figure 5:
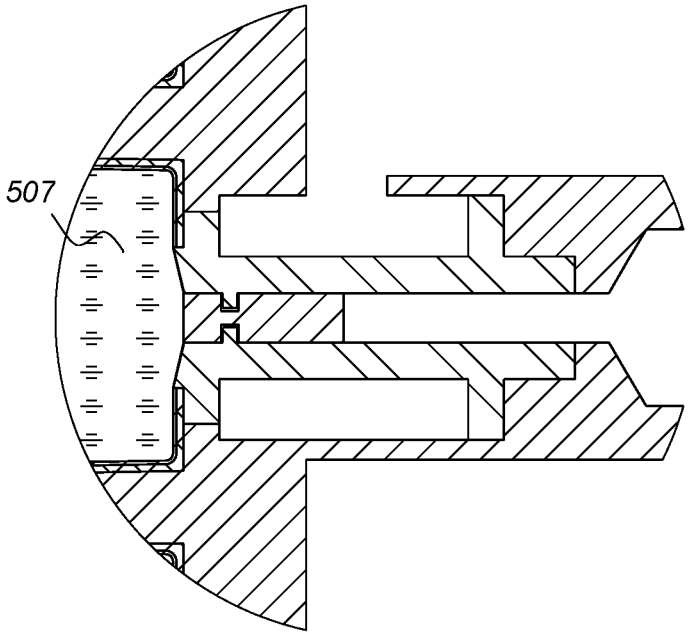

Reference is not made to FIG. 5, which are cross section diagrams of a compressed gas valve 500 for dry harvesting of ice. Compressed gas enters the valve at an orifice 501, surrounded by a valve cushion 502 mechanically connected to an outlet notch 505. In some embodiments, a pin 504 covers an outlet from the valve to prevent water from entering valve 500. A valve cushion pressure release outlet 503 allows the cushion to expand, thereby initiating the separation of ice 507 from the substrate 506.

Figure 6:
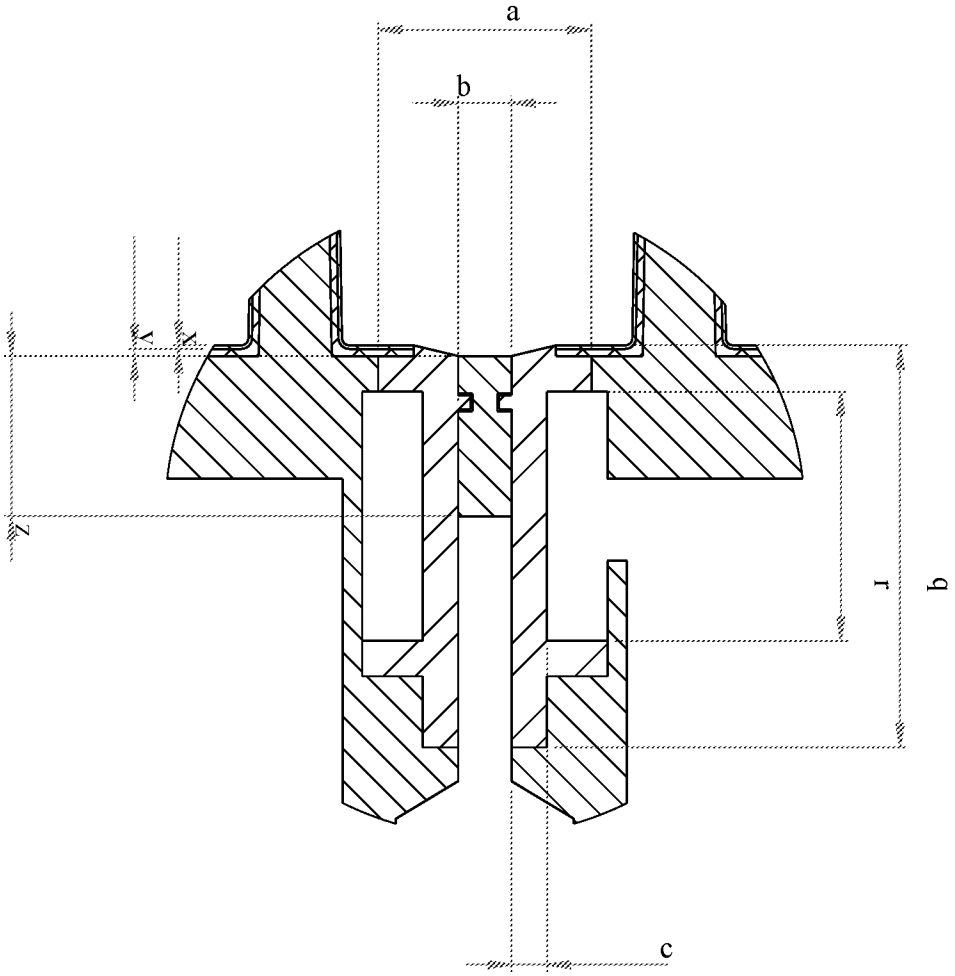
FIG. 6 is a cross section diagram of measurements of a compressed gas valve for dry harvesting of ice.

Reference is not made to FIG. 6, which is a cross section diagram of measurements of a compressed gas valve for dry harvesting of ice. Cushion outlet diameter is denoted a and cushion wall thickness is denoted c. A pin diameter is denoted b and a pin length is denoted z. Substrate may include a first layer with thickness denoted x and a second layer with thickness donated y. Length of inner valve part may be denoted q and length of expanding cushion portion may be denoted r. For example, ranges of values for dimensions of the gas valve in millimeters (mm) are given in the following table:

TABLE 3

| Dimension | Minimum (mm) | Maximum (mm) |
|---|---|---|
| a | 3 | 40 |
| b | 0.5 | 10 |
| C | 0.2 | 5 |
| Q | 5 | 100 |
| R | 3 | 90 |
| X | 0.05 | 2 |
| Y | 0.1 | 4 |
| Z | 2 | 40 |

Figure 7:
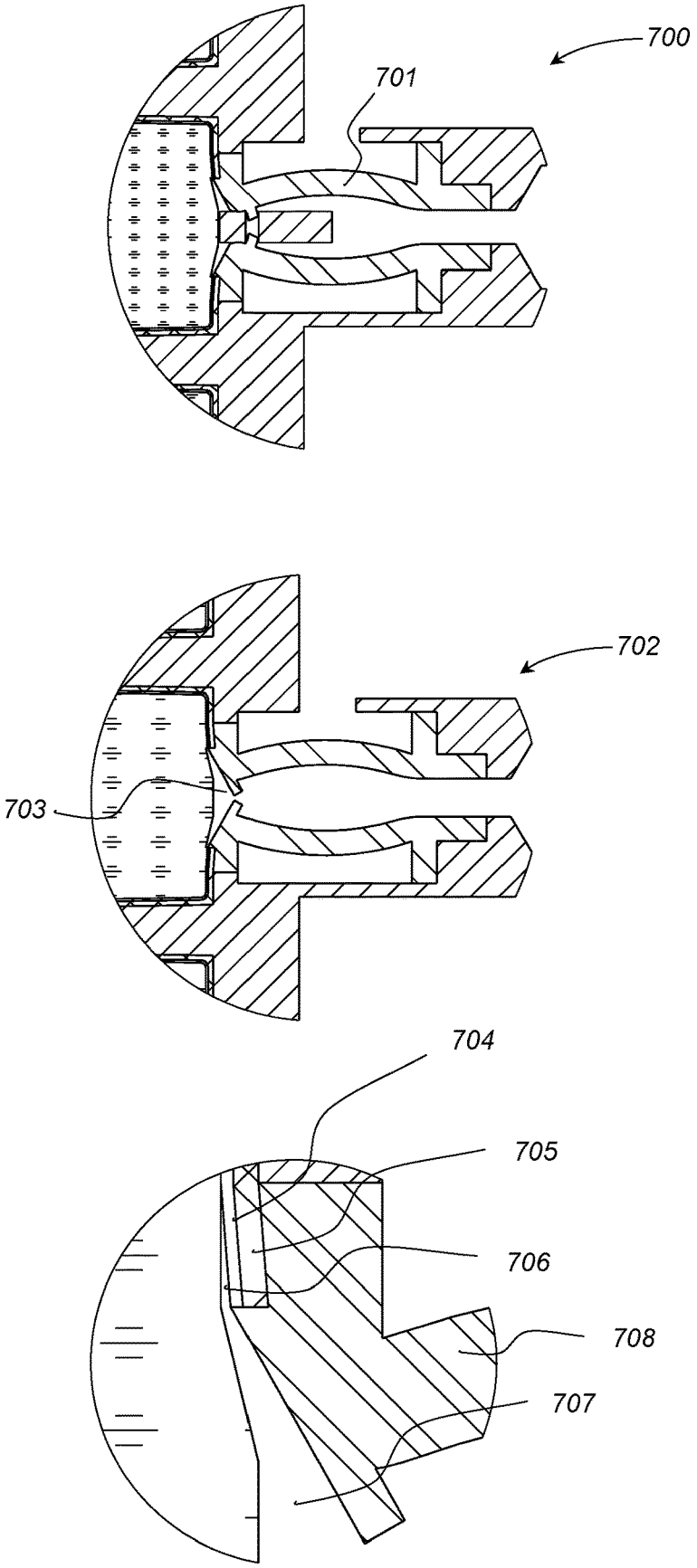
FIG. 7 are cross section diagrams of compressed gas valves for dry harvesting of ice during a separation stage.

Reference is not made to FIG. 7, which are cross section diagrams of compressed gas valves 700 and 702 for dry harvesting of ice during a separation stage. Valve 700 shows a cushion 701 expanding to initiation a separation between the ice and substrate. Valve 702 shows a cushion expanding without a pin to open a notch 703 in gas valve 702. For example, the notch opens when the cushion 708 expands. This allows compressed gas to pass 706 between the ice and substrate 704 and 705, after first existing the valve through the notch, such as between 707 the valve and the ice.

Figure 8:
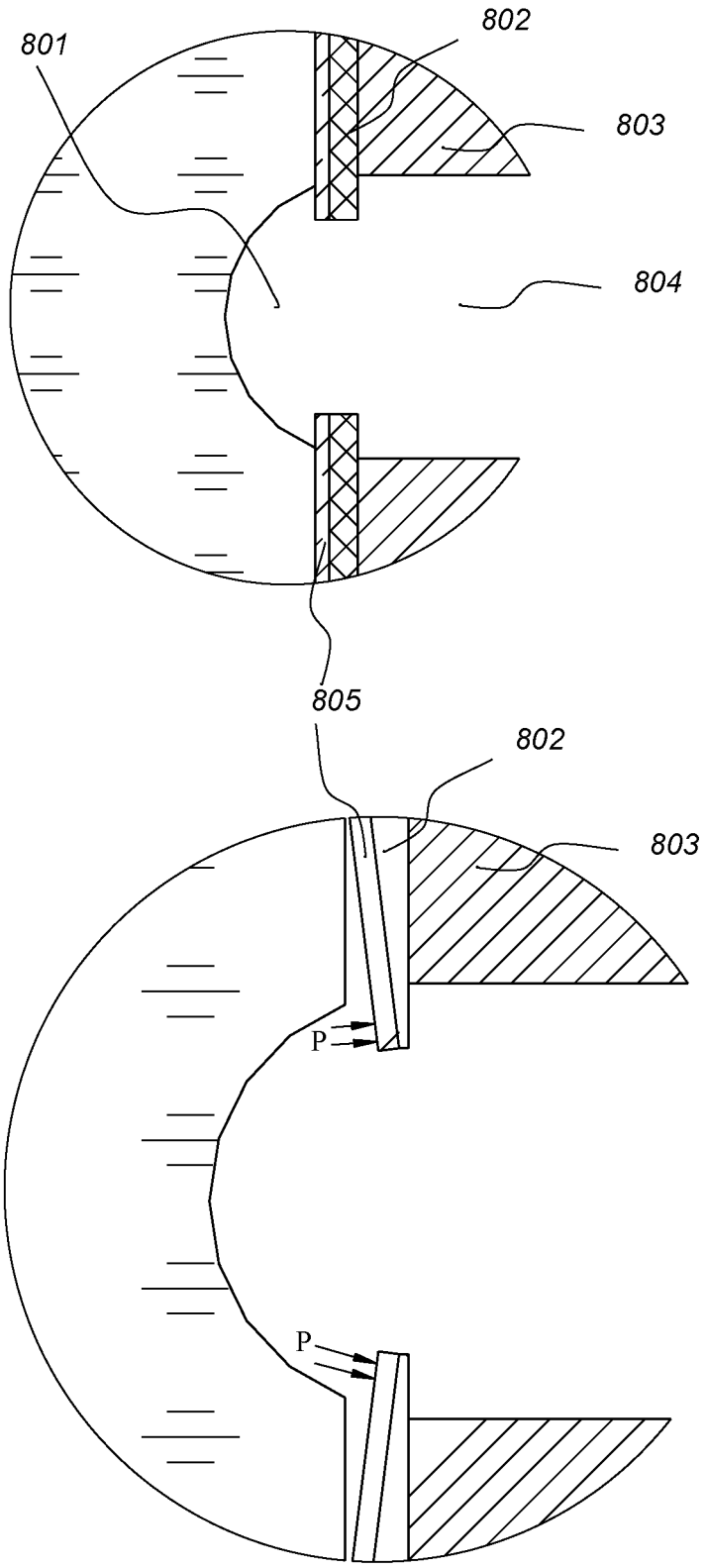
FIG. 8 are cross section diagrams of a gas bubble generated from a valve for dry harvesting of ice.

Reference is not made to FIG. 8, which are cross section diagrams of a gas bubble 801 generated from a valve for dry harvesting of ice. In this embodiment, the gas in valve 804 is slowly leaked through the notch during the formation of the ice, and after ice is formed gas bubble 801 covers the outlet. The gas bubble reaches elastic substrate 802 and 805 and grid 803, so that when compressed gas is applied to the valve, the separation is initiated by pressure P on elastic substrate 802 and 805.

Figure 9:
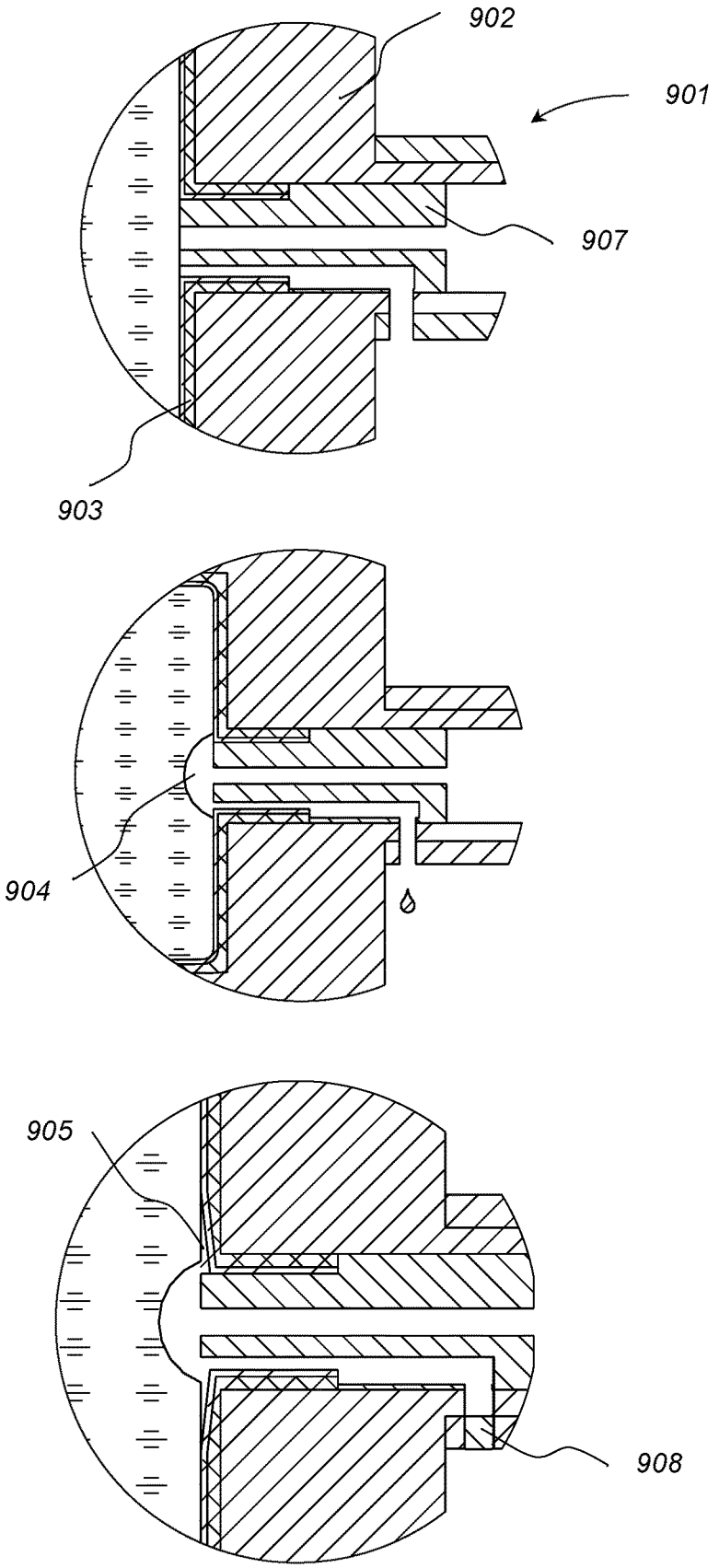
FIG. 9 are cross section diagrams of a gas bubble generated from a second valve for dry harvesting of ice.
Figure 10:
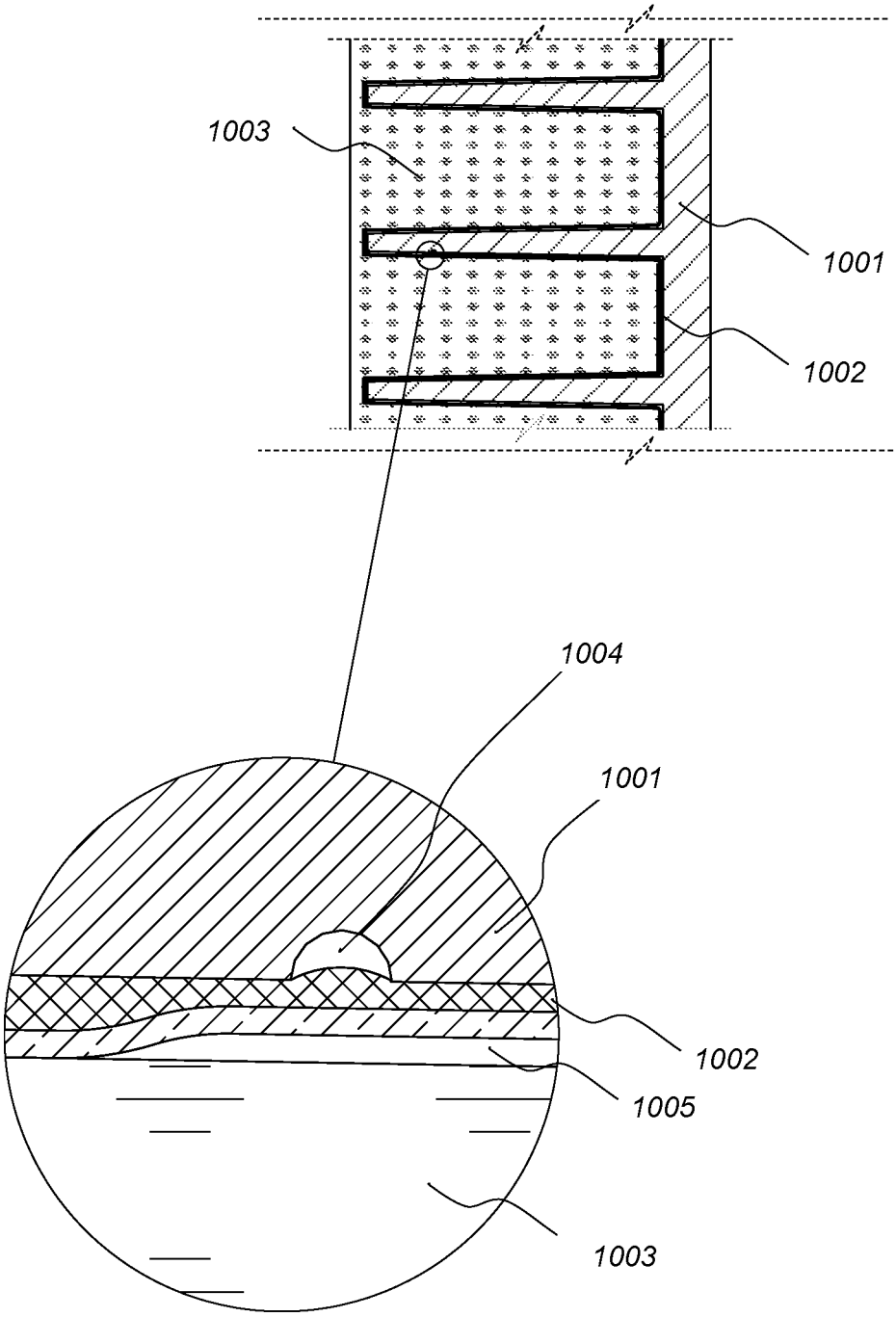
FIG. 10 are cross section diagrams of grid voids for dry harvesting of ice.

Reference is not made to FIG. 9, which are cross section diagrams of a gas bubble 904 generated from a second valve 901 for dry harvesting of ice. Multiple capillaries in valve 901 may allow leaking gas into the water during ice formation, resulting in gas bubble 904. When ice separation is initiated, the passing of the compressed gas between ice and substrate 903 moves substrate against grid 902, resulting in the initiation of separation, as in forming a crack 905. Optionally, the gas bubble over the valve is created by heating the ice surrounding the valve with a heating element 907 inserted into the valve and configured to drain the melted ice water. After the forming of a gas bubble, the ice water drain hole may be blocked with a plug 908. Reference is not made to FIG. 10, which are cross section diagrams of grid voids 1004 for dry harvesting of ice. Grid voids 1004 in a grid 1001 facilitate the separation of substrate 1002 from ice 1003 by providing a space for the elastic substrate to be displaced by the passing of compressed gas 1005.

Figure 11:
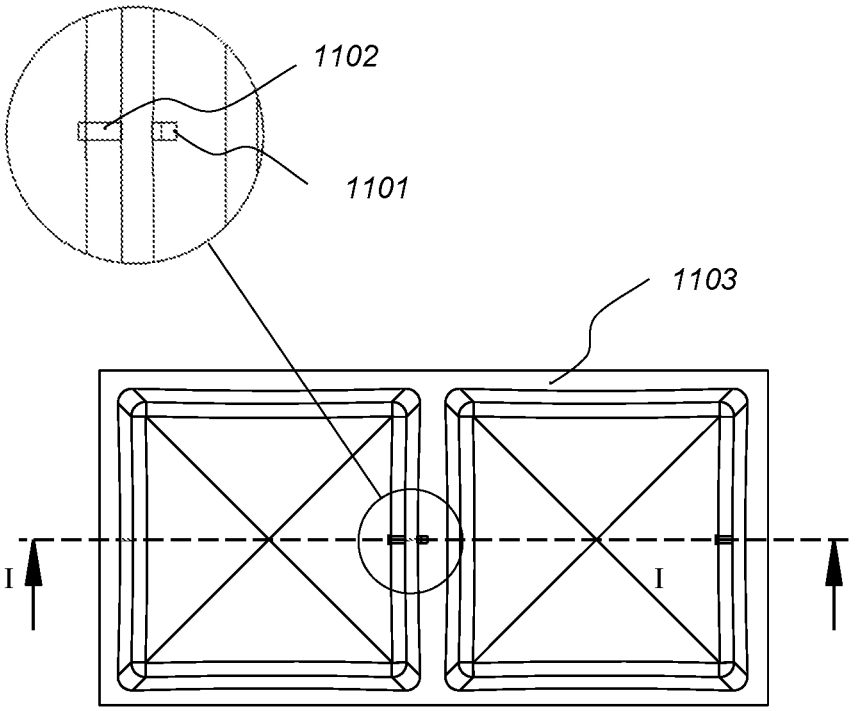
FIG. 11 are cross section diagrams of flexible regions of an elastic substrate for dry harvesting of ice.
Figure 11:
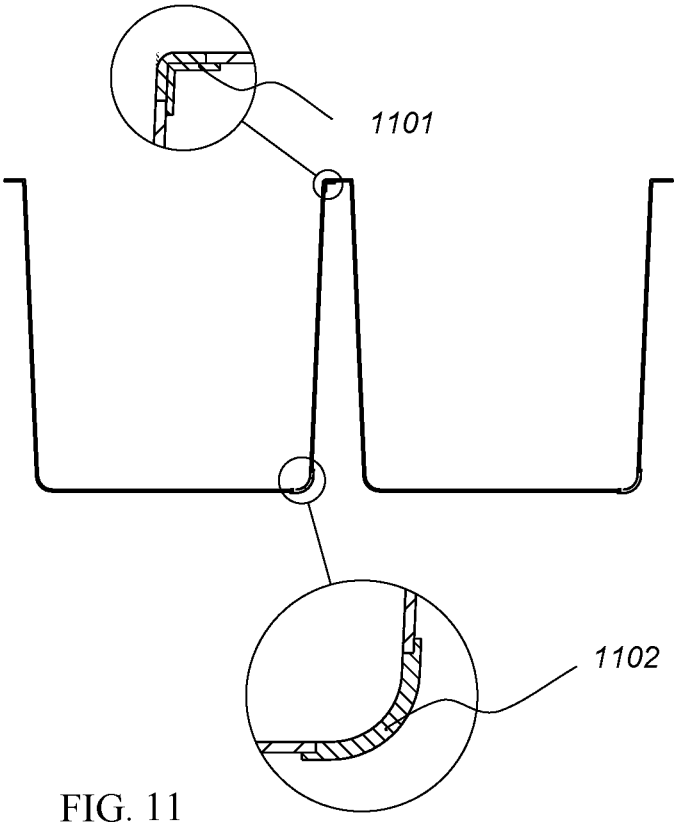

Reference is not made to FIG. 11, which are cross section diagrams of flexible regions 1101 and 1102 of an elastic substrate 1103 for dry harvesting of ice. Since the elastic substrate is compressible only in the direction of the grid, the corners of the elastic substrate, decrease the deflection degree and act as a profile and prevent motion of the substrate in all three directions. Thus, the corners of the substrate may become rigid. To allow the separation of the substrate from the ice to continue around corners, the substrate may include regions where the elastic substrate is more flexible, such as 1101 and 1102. For example, a first flexible region 1101 may include an elongated void around the corner between the substrate and the grid. For example, a second flexible region 1102 may include an increased thickness of elastic material around the corner.

Figure 12:
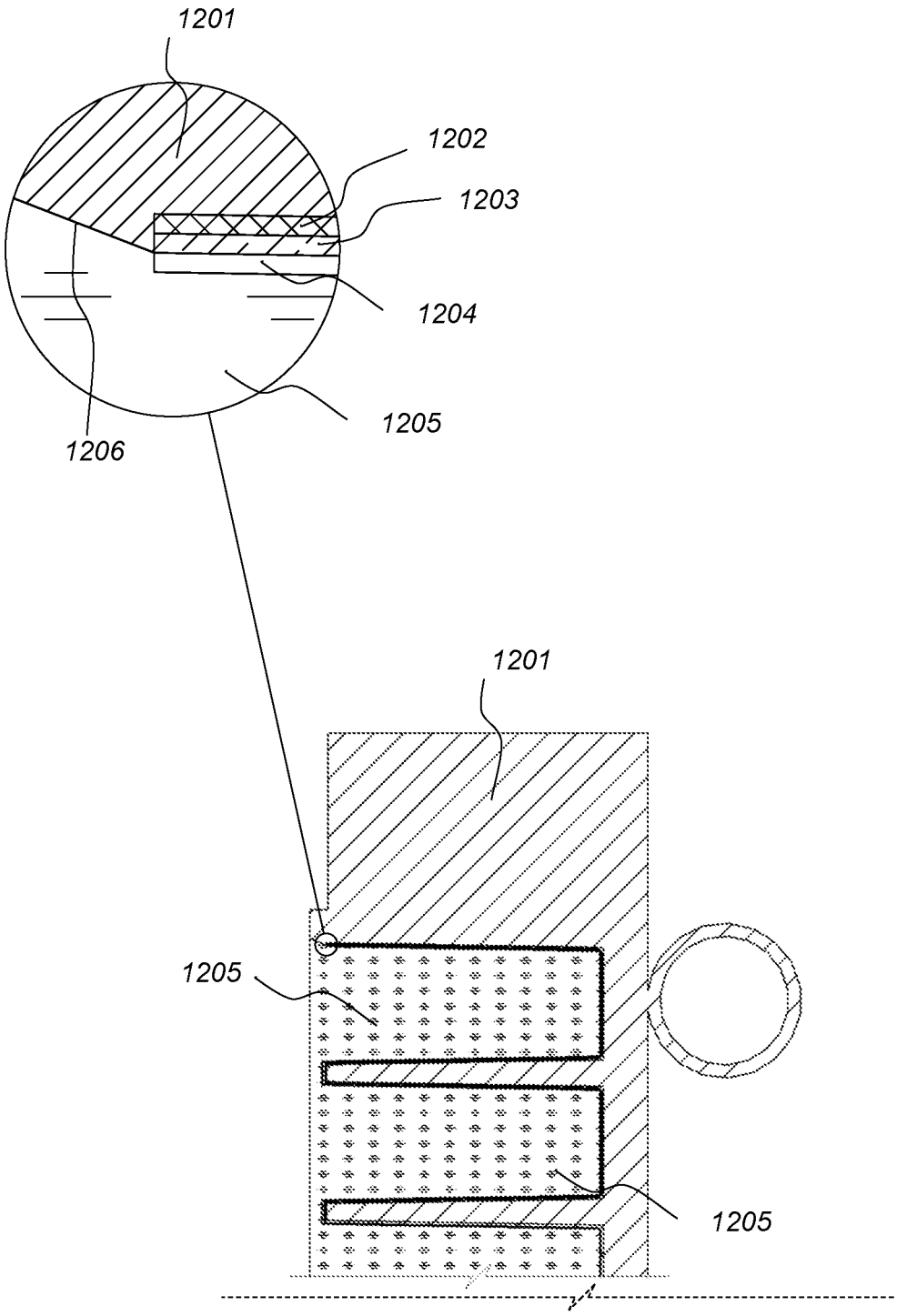
FIG. 12 are cross section diagrams of an ice plate seal for dry harvesting of ice.

Reference is not made to FIG. 12, which are cross section diagrams of an ice plate seal 1206 for dry harvesting of ice. Seal 1206 is created by a canted region extending around the ice plate 1205 where the elastic substrate 1202 and 1203 does not extend. This region prevents the compressed gas 1204 from escaping from between substrate 1202 and 1203 and ice 1205, and thus retains ice plate 1205 within grid 1201.

Figure 13:
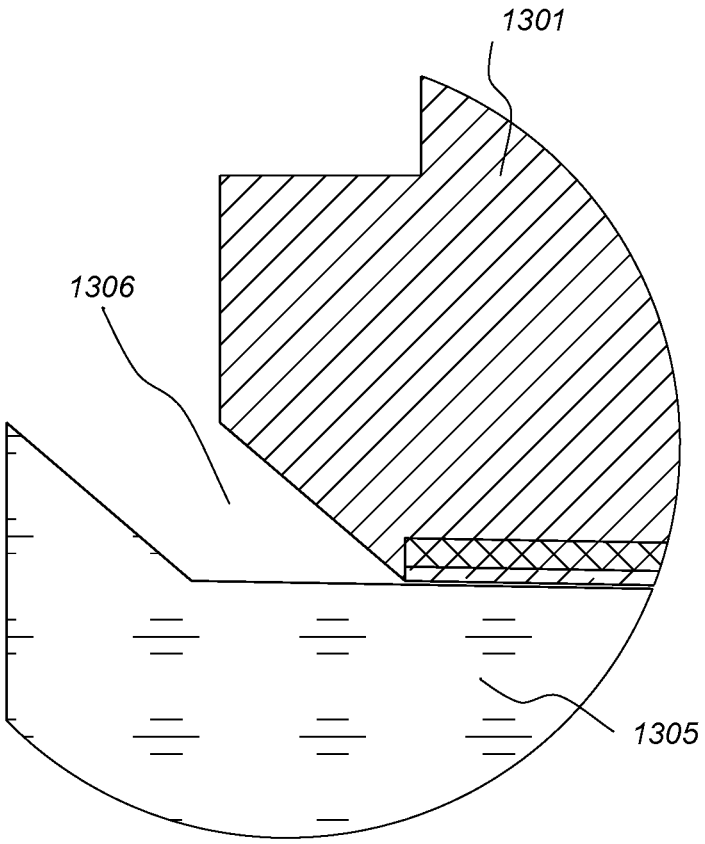
FIG. 13 is a cross section diagram of a separated ice plate seal for dry harvesting of ice.

Reference is not made to FIG. 13, which shows a cross section diagram of a separated ice plate seal 1306 for dry harvesting of ice. When the pressure is increased (or below in the case of a negative pressure embodiment), the seal is heated, the seal is mechanically moved, and/or the like, ice plate 1305 will leave grid 1301.

Figure 14:
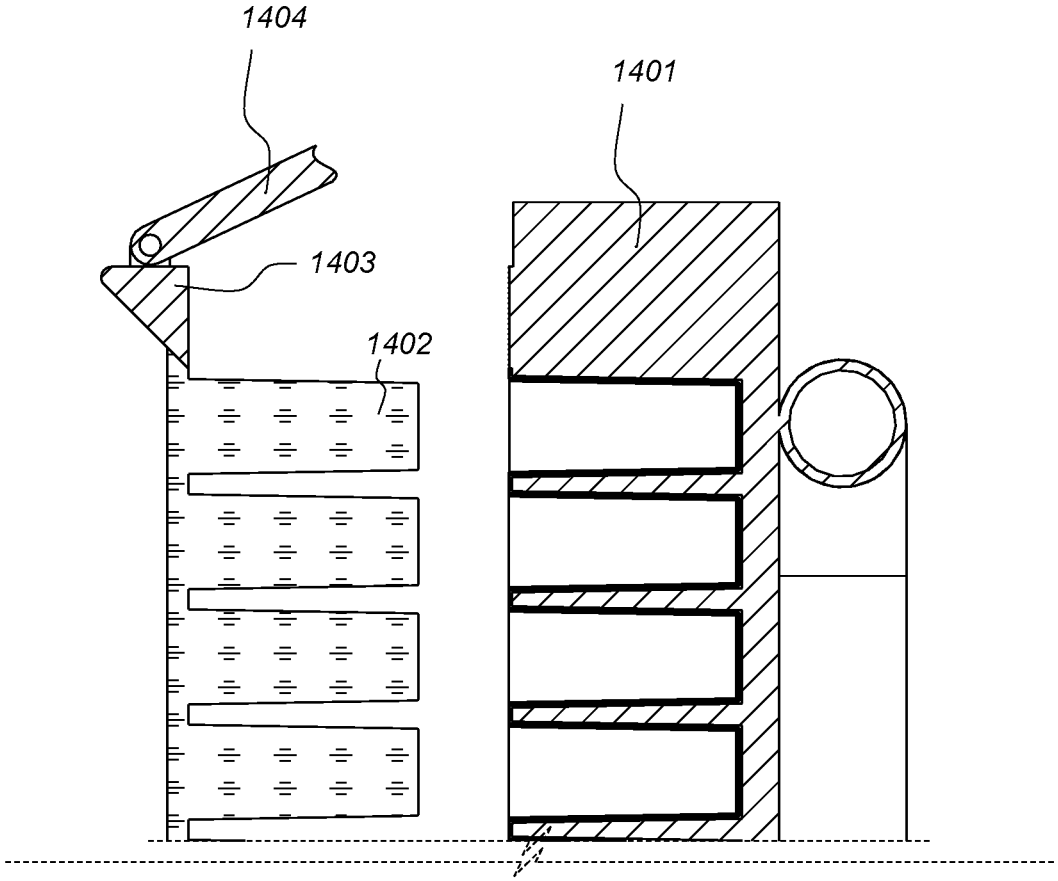
FIG. 14 is a cross section diagram of a mechanically separated ice plate seal for dry harvesting of ice.

Reference is not made to FIG. 14, which is a cross section diagram of a mechanically separated ice plate seal 1403 for dry harvesting of ice. When ice plate 1402 is separated from grid 1401, a mechanical level 1404 may move ice plate 1402 away from grid 1401 by pushing seal 1403 away from grid 1401. This mechanism provides a further benefit of building a new ice plate while ice plate 1402 is being transferred to a dispenser.

Figure 15:
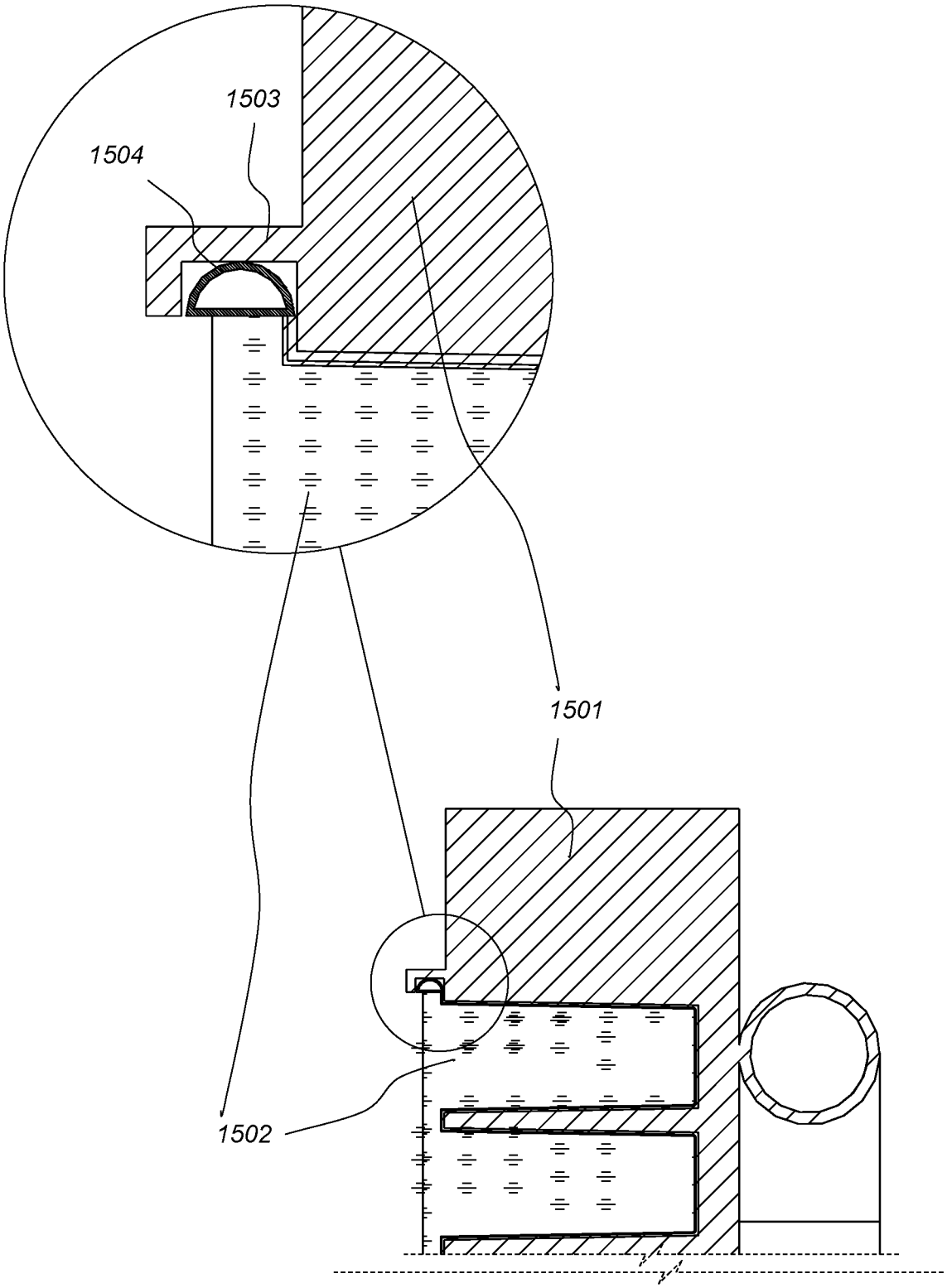
FIG. 15 is a cross section diagram of a pressure activated ice plate seal for dry harvesting of ice.

Reference is not made to FIG. 15, which is a cross section diagram of a pressure activated ice plate seal 1504 for dry harvesting of ice. When an ice plate 1502 is separated from grid 1501, pressure activated ice plate seal 1504 inside a seal rigid housing 1503 may be activated by receiving compressed gas that causes ice plate seal 1504 to expand or contract, and mechanically break the seal holding ice plate 1502 in grid 1501 and releasing the ice to the dispenser.

Figure 16:
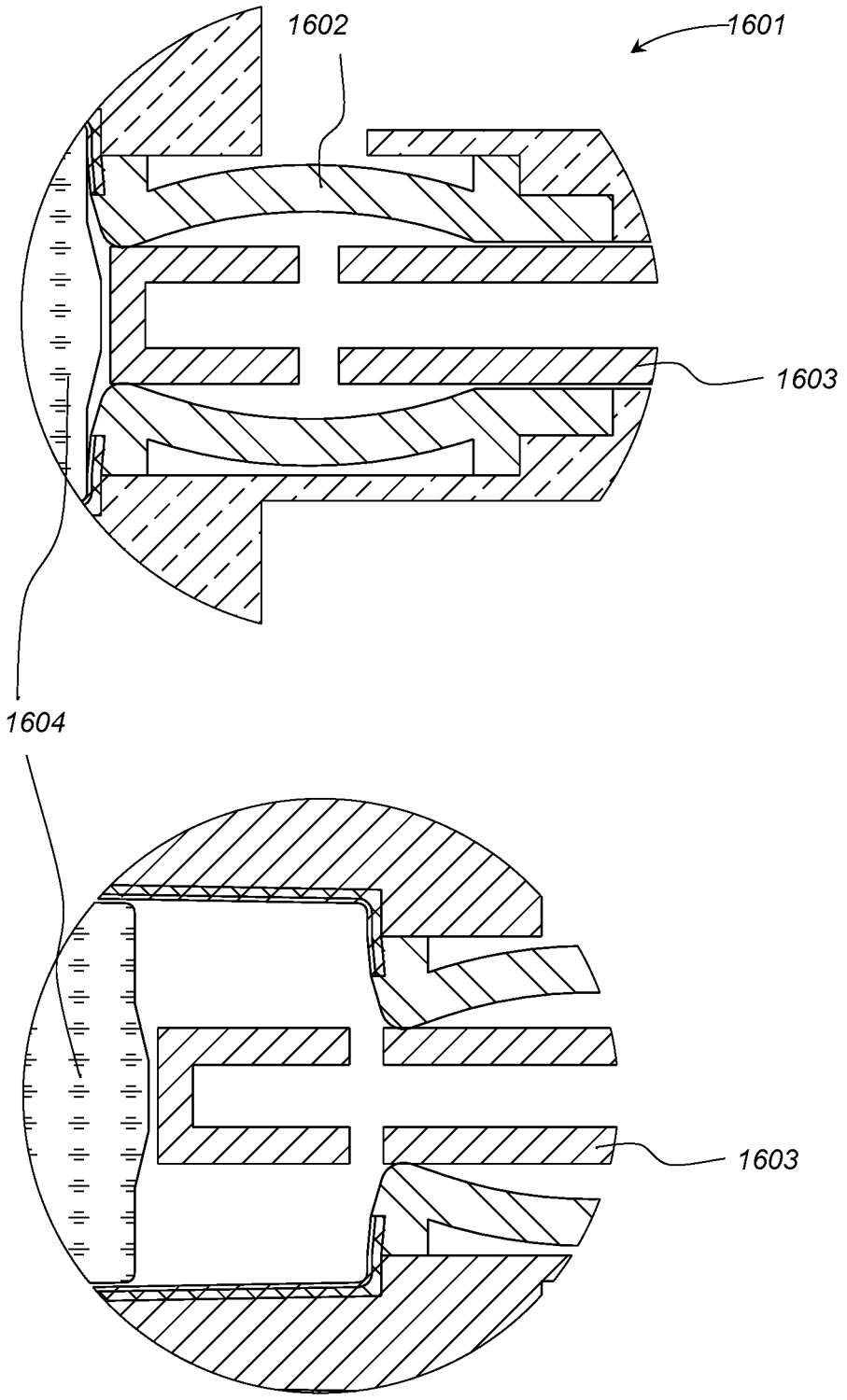
FIG. 16 is a cross section diagram of a valve with an ejection pin for dry harvesting of ice.

Reference is not made to FIG. 16, which is a cross section diagram of a valve 1601 with an ejection pin 1603 for dry harvesting of ice. Cushion 1602 is activated by gas pressure in valve 1601 separating ice plate 1604 from the grid. After separation, the ice plate is ejected by ejection pin 1603 mechanically pushing plate 1604 out of grid. Optionally, the plate ice is created when the grid is inverted, and the water is sprayed from below. Optionally, the plate ice is created when the grid is orientated at an angle, and the water is sprayed towards the grid. Optionally, a tube ice machine uses dry ejection embodiments as described herein.

Figure 17:
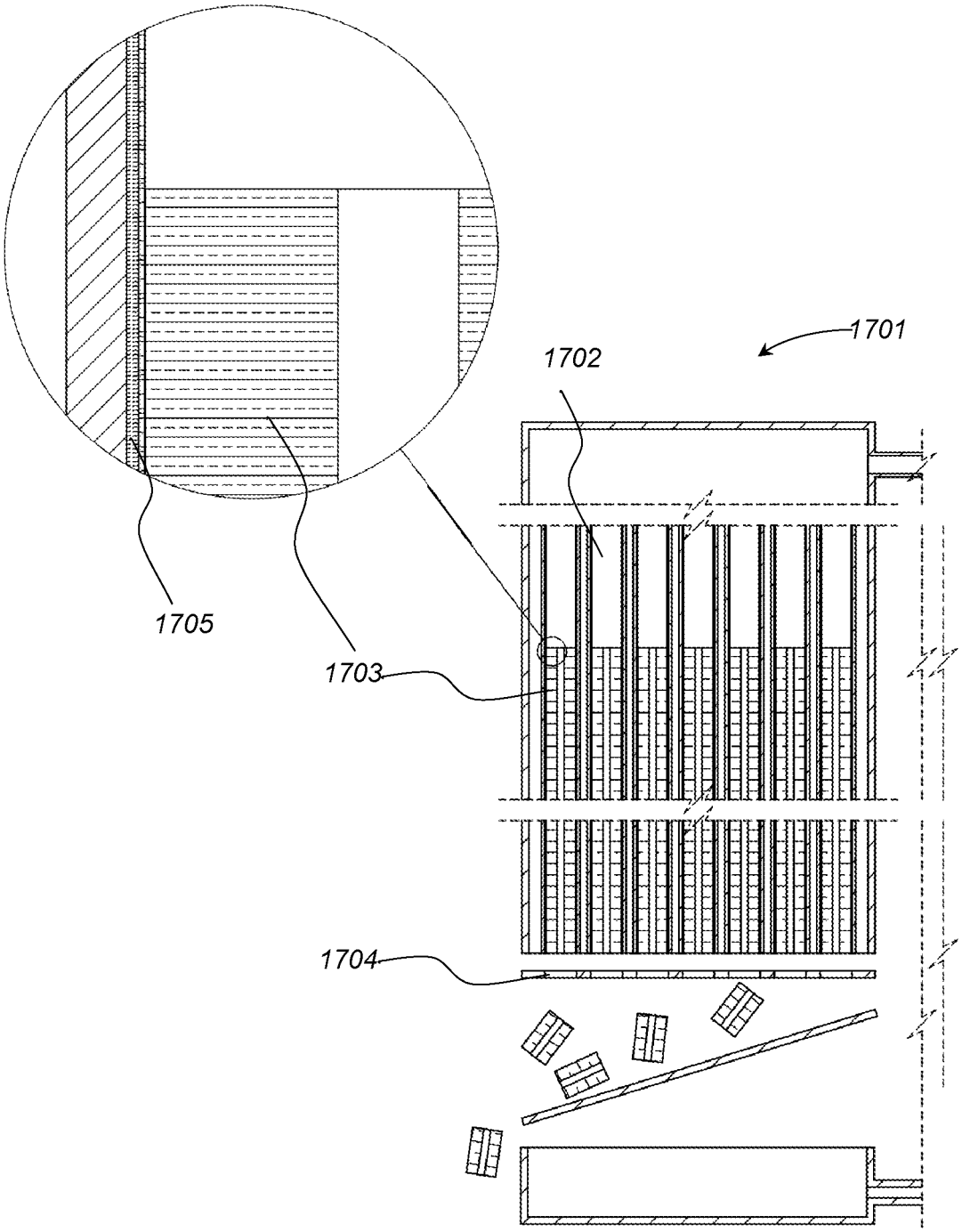
FIG. 17 are cross section diagrams of a tube ice machine with dry harvesting of ice.

Reference is not made to FIG. 17, which are cross section diagrams of a tube ice machine 1701 with dry harvesting of ice. Tube ice machine 1701 includes two or more tubes 1702 within a case for distributing the refrigerant. Each tube acts as a grid for the forming of tube ice 1703 and includes an elastic substrate 1705 for separating the tube ice 1703. Tube ice 1703 is ejected and a chopper 1704 cuts the elongated ice pieces into shorter ice tubes.

Figure 18:
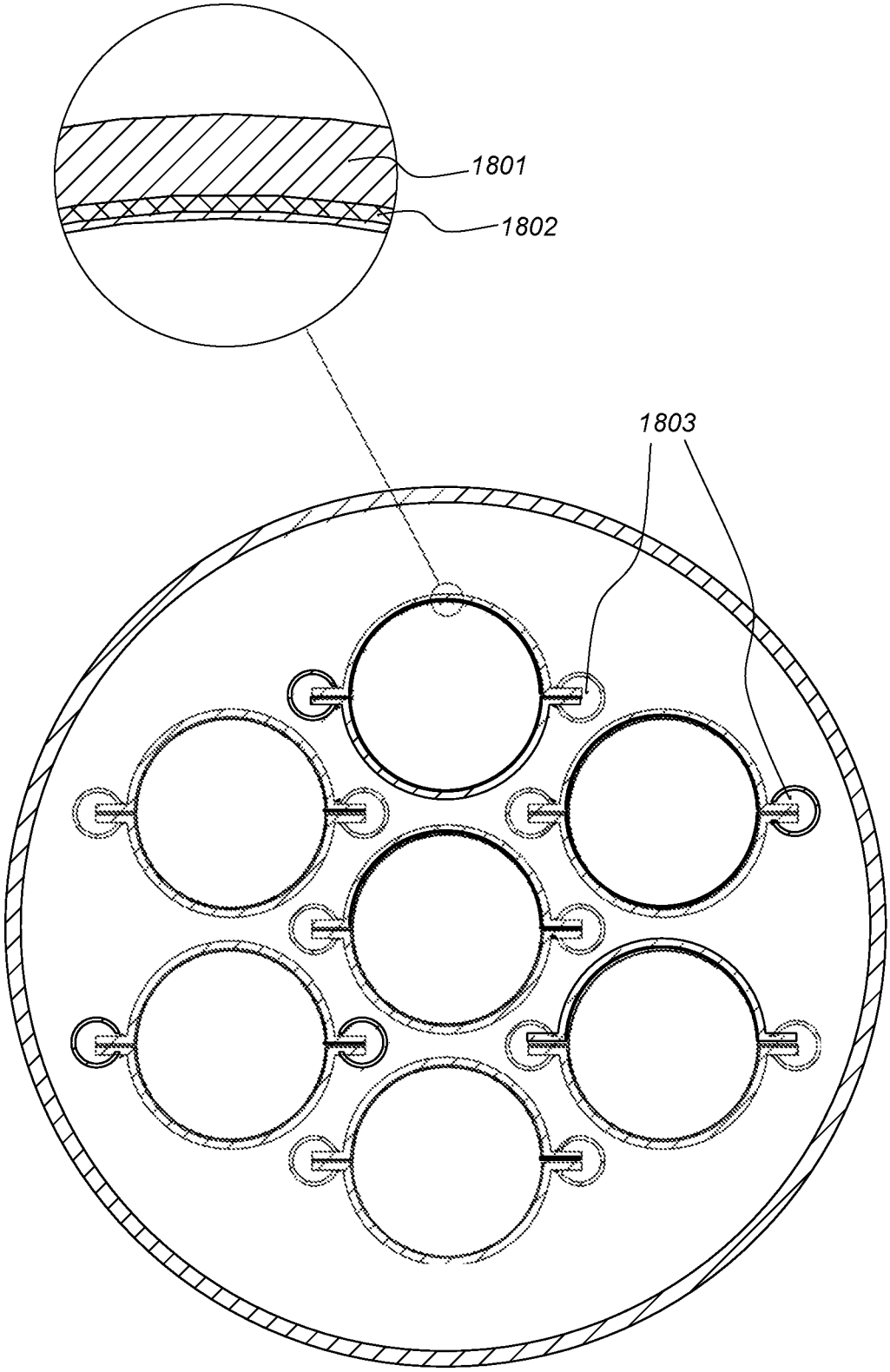
FIG. 18 are lateral cross section diagrams of a tube ice machine with dry harvesting of ice.

Reference is not made to FIG. 18, which are lateral cross section diagrams of a tube ice machine with dry harvesting of ice. Each evaporator grid, such as an ice tube 1801, has an inner covering of an elastic substrate 1802, and two or more ejection seals 1803, where the tube base material may act as an evaporator back board.

Figure 19:
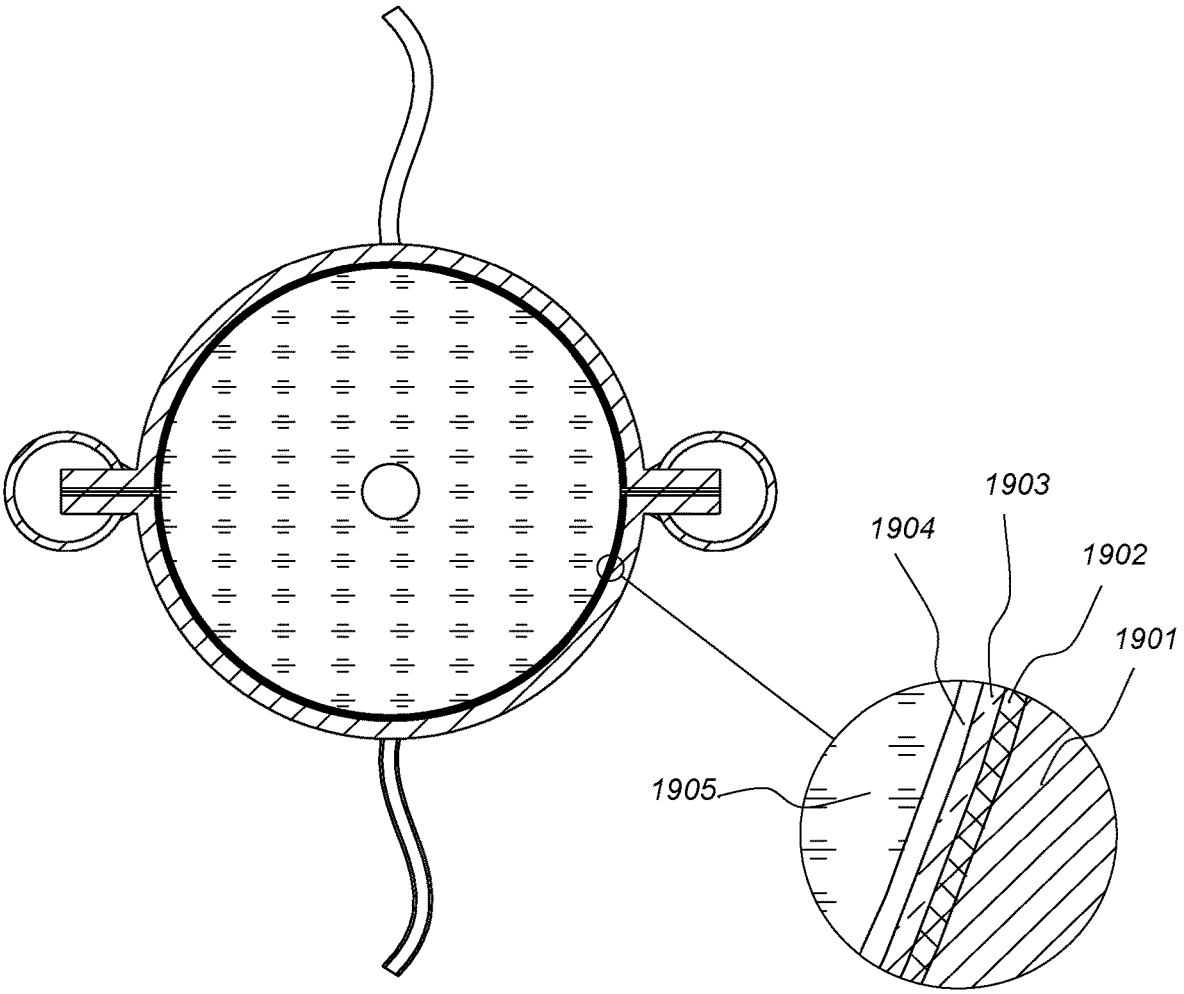
FIG. 19 are lateral cross section diagrams of an ice tube separation from an evaporator grid during dry harvesting of ice.

Reference is not made to FIG. 19, which are lateral cross section diagrams of an ice tube separation from an evaporator grid 1901 during dry harvesting of ice. The compressed gas from the valve passes between the ice 1905 and the elastic substrate layers 1902 and 1903, causing a separation 1904.

Figure 20:
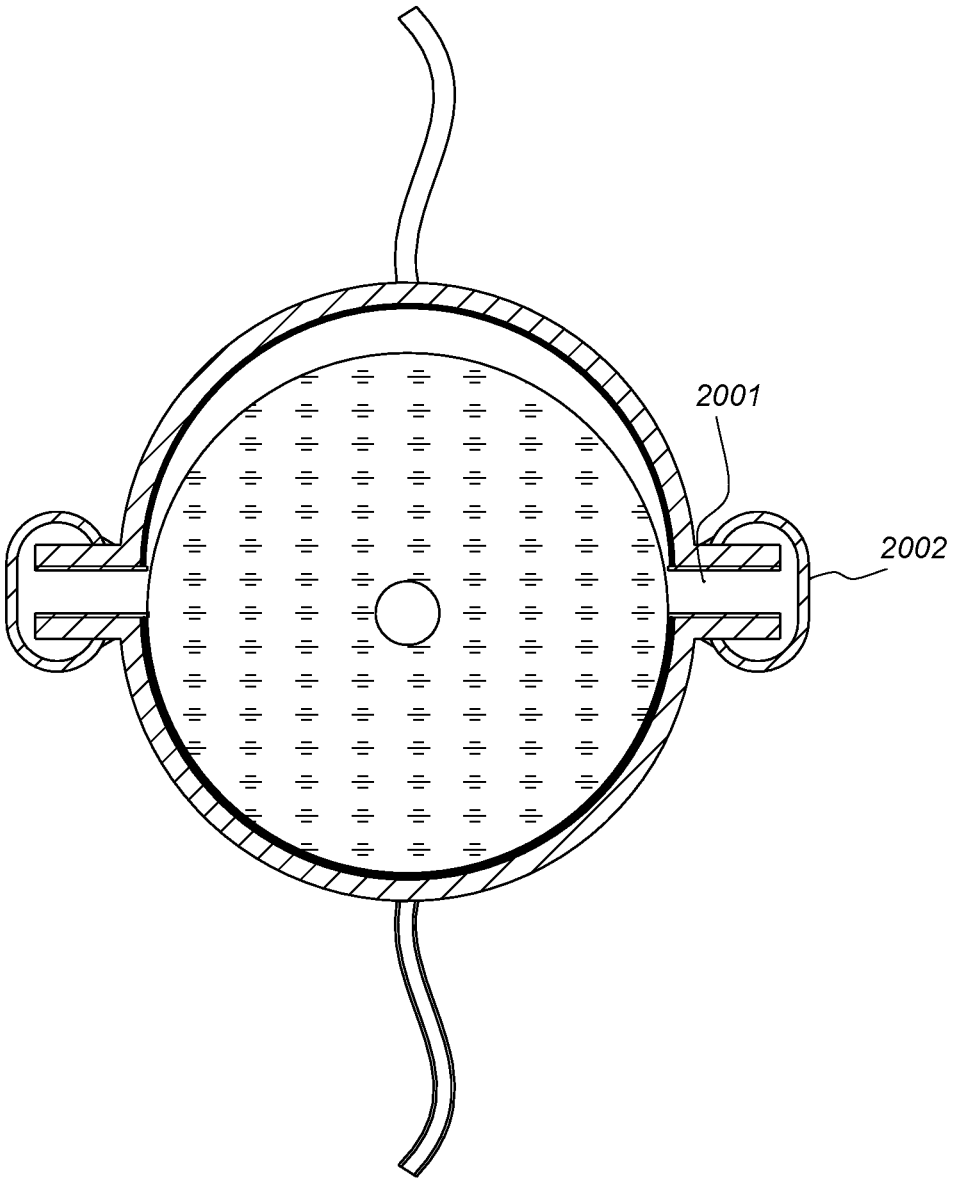
FIG. 20 is a lateral cross section diagram of an ice tube ejection from an evaporator grid during dry harvesting of ice.

Reference is not made to FIG. 20, which is a lateral cross section diagram of an ice tube ejection from an evaporator grid during dry harvesting of ice. Once the ice is mostly separated, the two or more seals 2002 separate to form a gap 2001, thereby releasing the ice which falls by the force of gravity towards the chopper.

Figure 21:
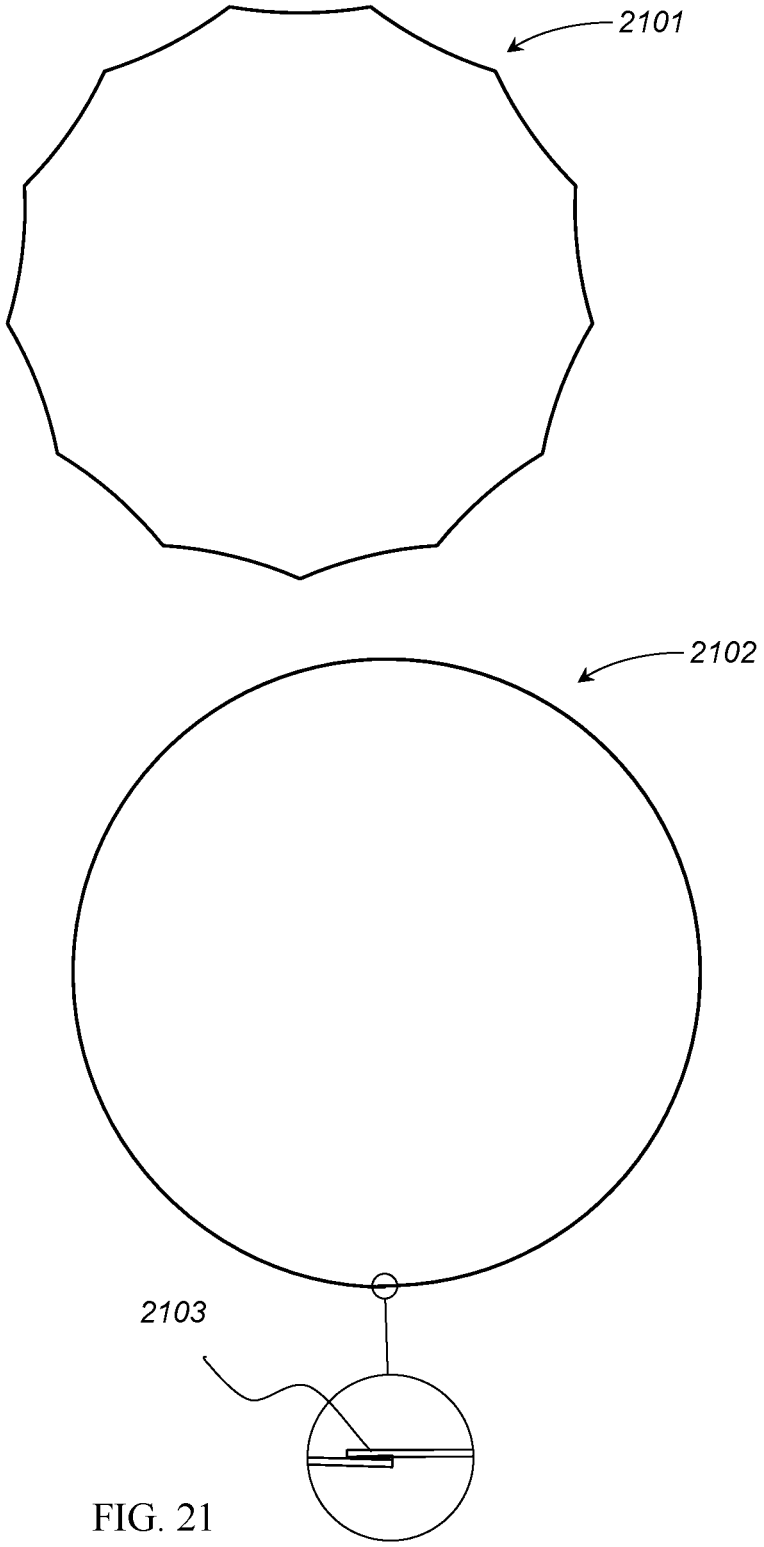
FIG. 21 are cross section diagrams of alternative ice tube ejection during dry harvesting of ice.

Reference is not made to FIG. 21, which are cross section diagrams of alternative ice tube ejection during dry harvesting of ice. A first tube type 2101 may have a star-shaped cross section that is inverted to a flower shape to eject the ice. A second tube type 2102 may have a moveable overlay section 2103 that allows increasing the circumference of tube 2102 to eject the ice. These shapes may be used in residential refrigerator ice makers, that produced half a discus shape ice cubes, with round edge.

Optionally, the dry ejection is incorporated into an ice making device as part of a commercial or residential refrigerator, like Whirlpool EZ Connect Icemaker Kit for Top Freezer Refrigerators, model #ECKMFEZ2. For example, each cell in a small grid comprises an elastic substrate and a valve for inserting compressed air between the formed ice and the elastic substrate. Residential refrigerator ice maker may include a metal ice mold with a heater placed on the bottom of the ice mold to melt the ice and release it during wet harvesting. Rotating ejector blades may be used to eject the ice from the ice mold by rotation movement of the blades. At the beginning of the process, water may be poured into one ice cell and flow to all other by small water tunnels and/or channels, such as a small opening in the ice cell side wall. When the water freezes, the 6 to 9 ice cubes connected with small ice bridge formed. During the wet harvesting stage, the small ice bridges melt, and the ice cubes separate, producing an esthetic ice cube. In the dry harvesting process, the ice bridges stay as is. To reduce the effect of ice bridges, one or more of the following options may be applied:

(i) increasing the volume, size, and/or shape of the rotating ejector blades, and use the blades inside each cell to decrease the water poured into each cell, (ii) during the water pouring use an inserted volume, such as a cover, so water will spread into adjacent ice cells, (iii) remove extra volumes in ice cell so water over bridge is displaced into cells, and/or (iv) the like.

Optionally, the elastic substrate is connected to a suction pump, and during the separation stage the suction pump pulls the elastic substrate from the formed ice.

Optionally, an ice slab of thickness less than 22 millimeters is produced and ejected using a dry ejection embodiment. For example, an ice slab is created in an ice machine with a thickness between 5 millimeters and 25 millimeters, and dry ejection is used to eject the ice slab from the elastic substrate. For example, ice cubes made from an ice slab with thickness less than 20 millimeters have a higher surface area than a typical ice cube, and therefore cool a liquid more efficiently than the typical ice cube.

Furthermore, a creating thinner ice slab may be more efficient, such as with a higher evaporator temperature, to manufacture and the ice slab thickness can be preserved better with dry ejection embodiments rather than wet ejection. For example, a 10-millimeter-thick ice slab may use an evaporator temperature of minus 10 degrees Celsius, while an ice slab of 20 millimeters thickness may use an evaporator temperature of minus 20 degrees Celsius.

Optionally, the elastic substrate may comprise a combination of polymers, such as derivatives of polysiloxanes (dimethyl-siloxane, H-methyl-siloxane and etc.), derivatives of epoxy-based photoresists (SU-8 and etc.), derivatives of polyethylene (PE, PET and etc.), derivatives of polycarbonate (PC), derivatives of polyamide (PA6), cellulose-containing material (for example Cellulose Acetate), rubber, and/or the like.

Optionally, the elastic substrate may comprise inorganic materials, such as metal oxides (titanium dioxide, zinc oxides, etc.), dielectric materials (silicon dioxide, aluminum oxide, etc.), metals (aluminum, copper, zinc, stainless steel, etc.), and/or the like. Special regions of increased or decreased flexibility may be configured around corners, allowing the compressed gas to pass to most locations between the ice and the grid. The metal cover of the elastic substrate may be shaped in a 'spring shapes', with round edges to achieve more flexibility. Optionally, the edges are less flexible so that a seal is formed within the flexible regions. For example, a rigid area of the elastic substrate may allow forming a seal around the edges of the ice plate during dry ejection.

Optionally, the elastic substrate may comprise high conductivity polymers, such as derivatives of polythiophene (poly(3,4-ethylenedioxythiophene) i.e. PEDOT, polymethylthiophene i.e. PMT, etc.), derivatives of polyphenylene (poly(p-phenylene sulfide) i.e. PPS, poly(p-phenylene vinylene) i.e. PPV, etc.), and/or the like.

Optionally, the elastic substrate may comprise heat conductive additives, such as heat conductive nano/micro particles of carbon, gold, etc., heat conductive nano wires or tubes made from carbon, gold, silver, etc., and/or the like. Optionally, node welding techniques are used to increase conduction, such as a heat conductive micromesh, a millimetric net made from aluminum/steel/copper, and/or the like.

Optionally, the elastic substrate may comprise hydrophobic materials and can be made from manganese oxide polystyrene, zinc oxide polystyrene, precipitated calcium carbonate, carbon nano-tube, silica, derivatives of fluorinated materials, and/or the like. Following are examples of valves, substrates, and/or the like that have been found to facilitate dry ejection of ice block(s).

For example, the elastic substrate is comprised of materials that will deform under 0.3 bar of pressure by 10 micrometers. With a thickness of 100 micrometers, the strain will be 0.1 and the elastic modulus will be 300 kilo-pascal. These are rough empirical estimates and are brought to understand the overall behavior of the elastic substrate. The elastic substrate may have a non-linear elastic behavior due to the flow of the incompressible material into the air voids in the grid changing the thickness of the elastic substrate between the ice and the grid.

For example, an elastic substrate includes a flexible layer of room temperature vulcanization (RTV) silicone (0.2 mm thickness, Shore hardness 40 A) and a stiff layer of phosphor bronze (0.1 mm thickness). A valve hole with a flexible part and a 1.5 mm compressed air outlet orifice was able to separate the ice at a pressure of ⅕ bar above ambient pressure and at a temperature of −15 degrees Celsius. For example, without the flexible part of the valve, even a gas pressure of greater than 7 bar above ambient pressure was not able to separate the ice block from an example elastic substrate. For example, with an elastic substrate of 0.25 mm thickness, a thermal conductivity of 11 Wm/K, and a Shore hardness of 60 (OO scale), an ice cube will be only 3% smaller in volume with the same amount of freezing time.

Optionally, an embodiment includes an ice support plate for using dry harvesting techniques in ice machines. For example, the ice support plate prevents bending stresses in the ice block/slab/plate and a resulting crack in the ice that prevents the propagation of the separation between the elastic substrate and the ice. For example, the ice support plate is a rigid structure with contact points on the ice block, and when the ice freezes it is connected to the ice support plate. This may add mechanical strength to the ice plate during the separation stage of the ice from the elastic substrate.

Figure 22:
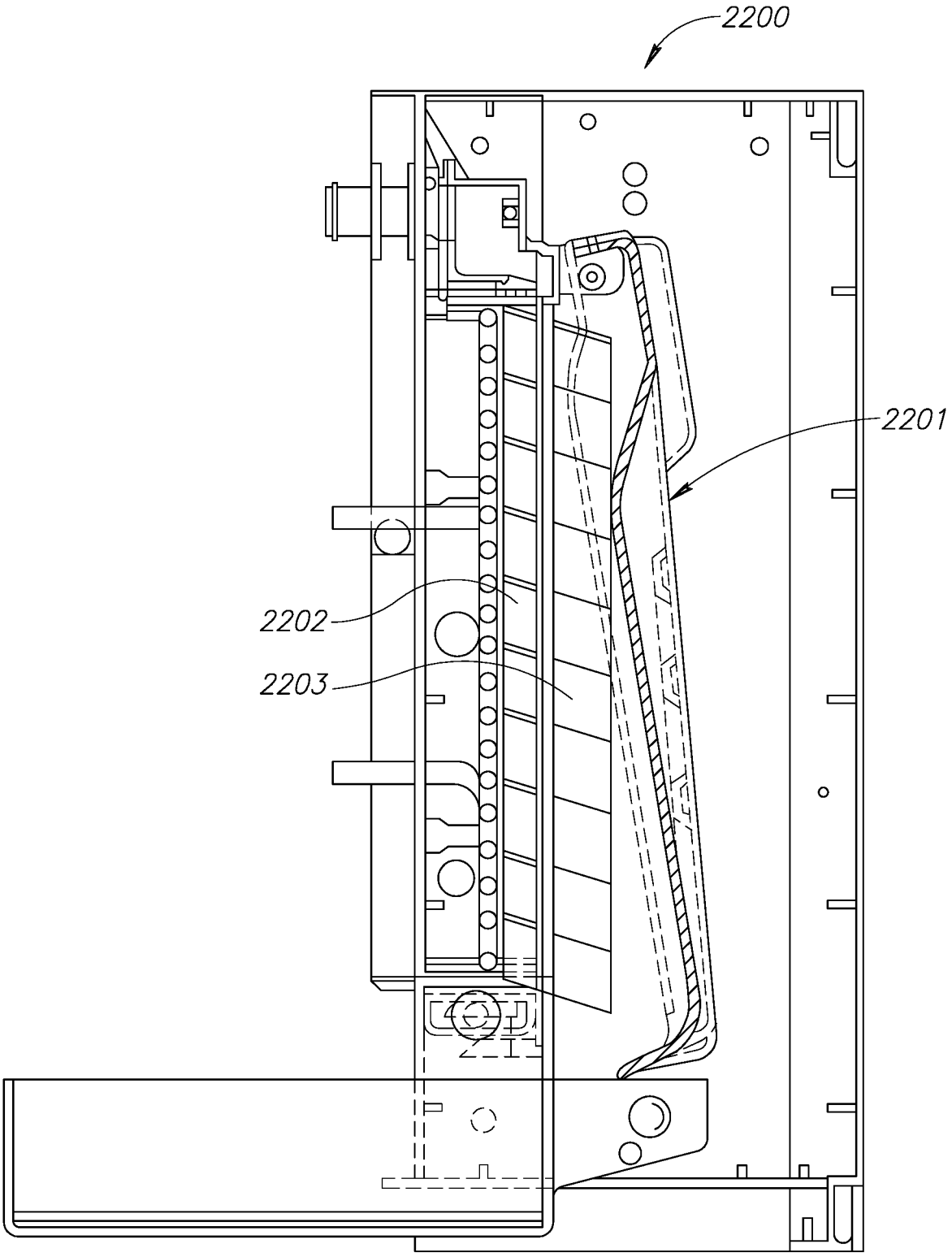
FIG. 22 is a schematic illustration of an embodiment for dry ejection with a splash curtain.

Reference is now made to FIG. 22, which is a schematic illustration of an embodiment 2200 for dry ejection with a splash curtain. A water curtain or a water splash curtain 2201, which is located at the front of an evaporator 2202, prevents water from splashing from the evaporator, during the freezing process. At the end of the freezing process water curtain 2201 is pushed by an ice slab 2203. After dry ejection, ice slab 2203 falls to a storage bin.

Figure 23:
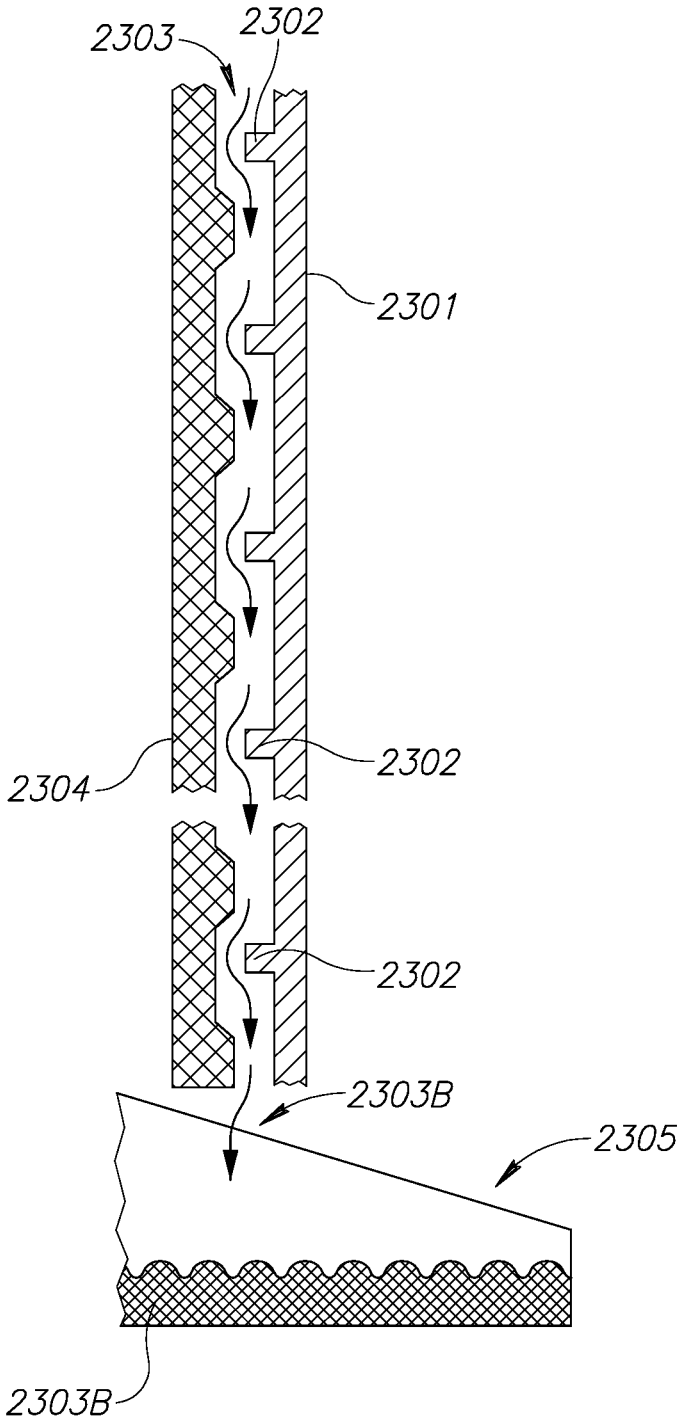
FIG. 23 is a schematic illustration of an embodiment for dry ejection with a splash curtain before ice formation.

Reference is now made to FIG. 23, which is a schematic illustration of an embodiment for dry ejection with a splash curtain before ice formation. An ice supporting plate 2301, optionally, attached to a splash curtain, replacing a splash curtain, separate from a splash curtain, and/or the like, may be used for dry harvesting ice machines. Ice supporting plate 2301 may comprise ribs 2302 that may be follow a geometric shape and/or orientation, such as horizontal, vertical, angled ribs, dots, and/or the like. Water 2303 flows between an evaporator 2304 and ice supporting plate 2301 during the formation of an ice plate and starts to freeze on evaporator 2304. Water that doesn't freeze 2303B, flows down to the water reservoir 2305. The ice supporting plate 2301 may serve as a splash curtain.

Figure 24:
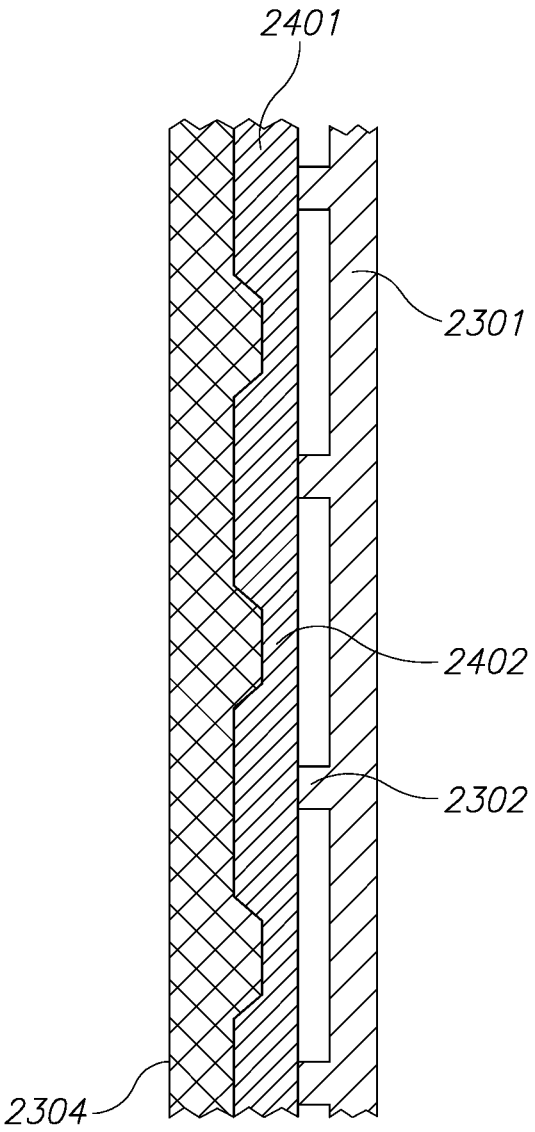
FIG. 24 is a schematic illustration of an embodiment for dry ejection with a splash curtain after ice formation.

Reference is now made to FIG. 24, which is a schematic illustration of an embodiment for dry ejection with a splash curtain after ice formation. At the end of the freezing process, an ice slab 2401 may form on evaporator 2304 and may bond to ice supporting plate ribs 2302. Ice slab 2401 may comprise ice bridges 2402, such as for separation of ice slab 2401 to ice cubes.

Figure 25:
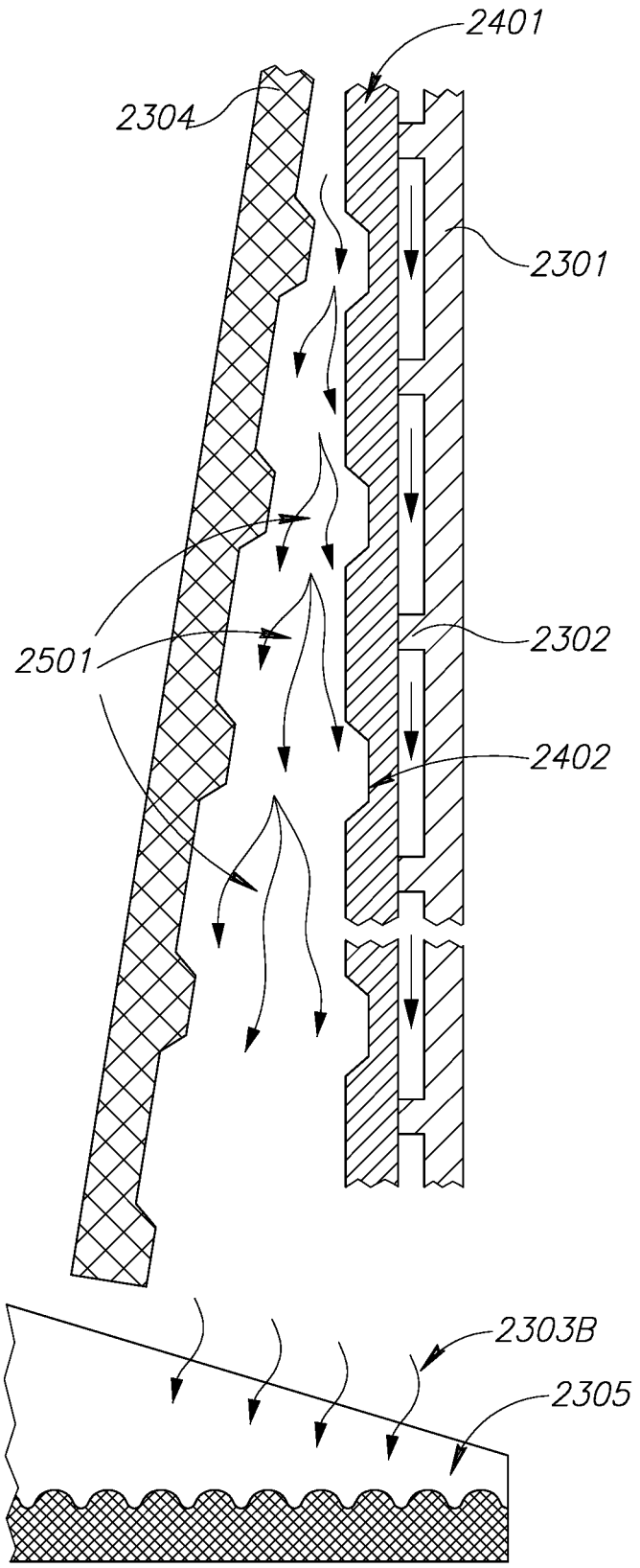
FIG. 25 is a schematic illustration of an embodiment for dry ejection with a splash curtain during ice ejection.

Reference is now made to FIG. 25, which is a schematic illustration of an embodiment for dry ejection with a splash curtain during ice ejection. After the freezing process is completed, compressed air 2501 may be forced between evaporator 2304 and ice slab 2401, and separation begins (i.e. as part of the dry harvesting process). Ice supporting plate 2301 strengthens the ice bridges 2402 and keeps them from breaking during the dry ejection by giving mechanical support for ice bridges 2402 using ribs 2302 connected to support plate 2301. Optionally, water may be forced between support plate 2301 and ice slab 2401 to separate these two, optionally in addition to compressed air 2501, and excess water 2303B may flow into water collection reservoir 2305. For example, the water heats supporting plate 2301 and causes ribs 2302 to separate from for ice slab 2401.

Ice slab 2401 with the ice supporting plate 2301, which may be bonded together, may be pushed away from the evaporator 2304 (i.e. ejection process). Water may flow again between evaporator 2304 and ice slab 2401 or/and between the ice slab 2401 and the support plate 2301, that may be bonded to ice supporting plate 2301, heating and releasing ice slab 2401 from ice supporting plate 2301 and simultaneously, may freeze on evaporator 2304. The pushing mechanism of the ice slab may be electrical or based on a pneumatic actuator mechanism that may push or rotate ice slab 2401 and ice supporting plate 2301.

Figure 26:
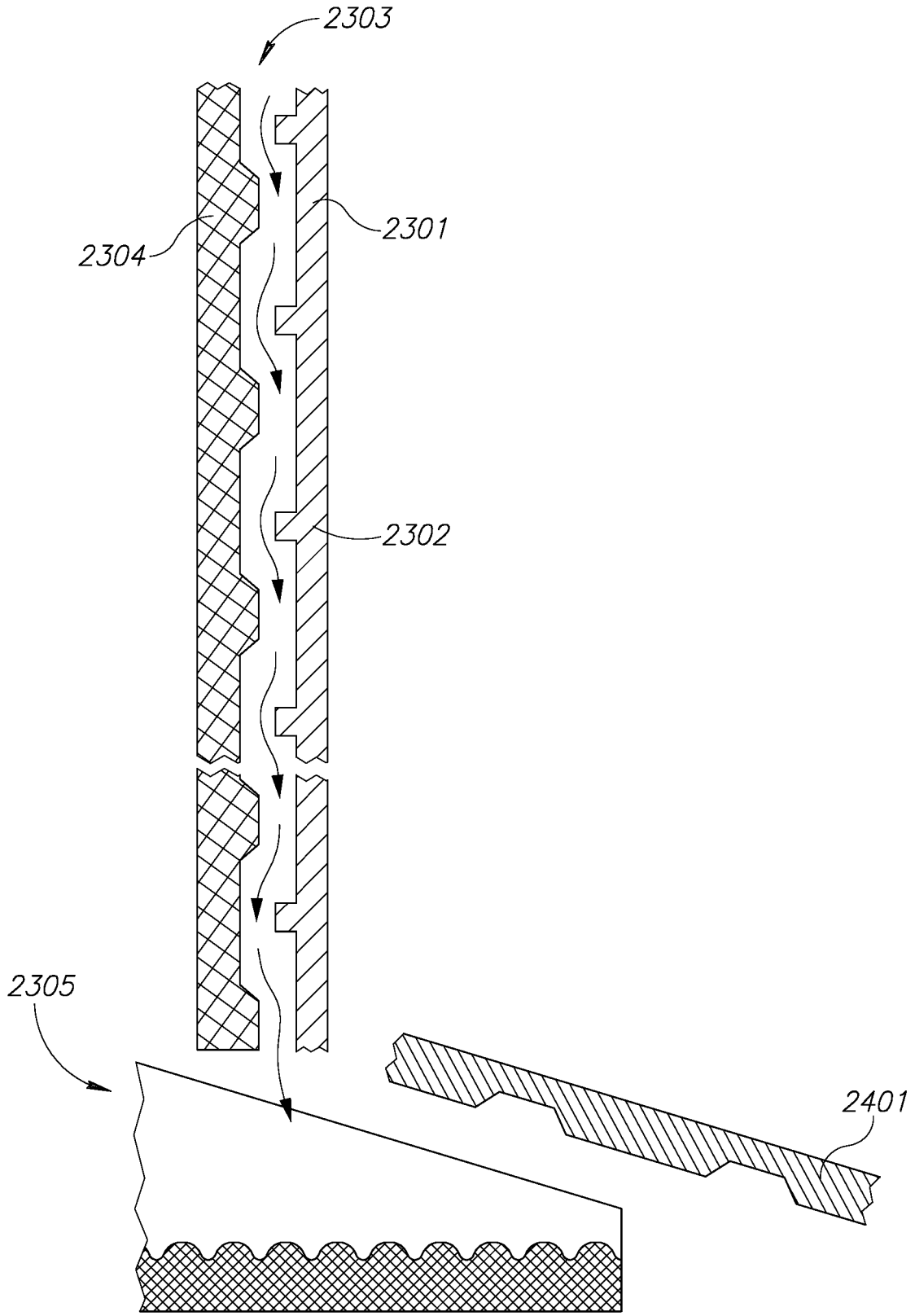
FIG. 26 is a schematic illustration of an embodiment for dry ejection with a splash curtain after ice ejection.

Reference is now made to FIG. 26, which is a schematic illustration of an embodiment for dry ejection with a splash curtain after ice ejection. Ice slab 2401 may be released from ice supporting plate 2301 and fall to a storage bin.

Ice supporting plate 2301, may be used on vertical or horizontal evaporators, and may have water inlet and outlet holes, air inlet and outlet holes, soft regions with low shore hardness polymers (i.e. elastomers) that may assist the air progression in the separation process of the dry harvesting.

Optionally, the ice supporting plate may comprise regions of higher flexibility than other regions, thereby allowing creation of an ice slab without ice bridges by pressing the ice supporting plate to the elastic substrate.

Optionally, the ice supporting plate may comprise air channels for applying compressed air to the grid for ice slab separation, bending prevention during ejection, and/or the like. Optionally, the air channels apply suction to the ice slab and/or elastic substrate.

Optionally, the grid and/or elastic substrate is produced from strips and welded together, such as to produce high drafting angles. Optionally, the strips comprise a notch to assist in assembly of the grid.

Optionally, the grid has shallow ice cube forming walls. For example, the walls of a grid for dry ice ejection are 10 millimeters in height. For example, the walls of a grid for dry ice ejection are between 3 and 20 millimeters in height. For example, the elastic substrate wall height is 4 mm, and the wall is attached to a flat evaporator board, such as an evaporator back board, without strips, to improve ice machine cost reduction.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

In the description and claims of the application, each of the words "comprise" "include" and "have", and forms thereof, are not necessarily limited to members in a list with which the words may be associated. In addition, where there are inconsistencies between this application and any document incorporated by reference, it is hereby intended that the present application controls.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Reference is made to FIG. 27A-D, which are top view, detailed view, and bottom view simplified illustrations of an ice maker with dry harvesting in accordance with some embodiments of the invention. In some embodiments, tray 2700 is made from one-piece high conductive metal like Copper, Aluminum, Bronze, etc. made by a metal drawing, metal sheet bending process, casting or metal injection for example, having been assembled with a number of cells made from elastic substrates 2701 and elevated openings shaped like a conduit 2702, for example, between these elastic substrates 2701. In some embodiments, each elastic substrate is connected to a gas valve 2703. In some embodiments, during the water filling process, the tray 2700 is used as a sump, enabling water to flow and fill all cells made from elastic substrates 2701, without spilling outside of the tray 2700, or inside through the conduit 2702. In some embodiments, the conduit 2702 enables hot air flows from the bottom side of the tray 2700 through the conduit to the top side of the tray.

In some embodiments, the conduits 2702 are made from the same materials as the tray 2700. In some embodiments, the conduits are made from a metal having high thermal conductivity such as, but not limited to Copper, Aluminum, and bronze. In some embodiments, the conduits have an oval cross section. In some embodiments, the conduits comprise an inner portion and an outer portion. In some embodiments, the inner portion of the conduit 2702 is a shared wall of a grid recess 2705. In some embodiments, the inner position of the conduit 2702 is an integral part of an ice grid recess 2705. In some embodiments, the inner portion thickness of the conduit 2702 ranges between 1-5 mm. in some embodiments, the inner portion length of the conduit 2702 ranges between 1-10 cm. in some embodiments, the inner portion width of the conduit 2702 ranges between 1-10 cm. in some embodiments, the outer portion of the conduit 2702 is raised in comparison to the ice grid recesses 2705. In some embodiments, the outer portion thickness of the conduit 2702 ranges between 1-5 mm. in some embodiments, the outer portion length of the conduit 2702 ranges between 1-10 cm. in some embodiments, the outer portion width of the conduit 2702 ranges between 1-10 cm.

In some embodiments, the ice maker comprises individual gas valves providing fluid communication between at least one individual grid recess 2705 and a gas source. In some embodiments, an individual gas valve is connected to one individual grid recess 2705. In some embodiments, an individual gas valve is connected to one or more grid recess 2705. In some embodiments, an individual gas valve is used to harvest the ice blocks formed within the grid recess 2705 by creating a positive or negative pressure gradient between the gas valve and the grid recess 2705 substrate.

A potential advantage of an individual gas valve being connected to one and/or few individual grid recesses 2705, is that the gas pressure required for the release of the ice blocks is smaller than the pressure required for the release of an entire grid using the same single gas valve.

A potential advantage of an individual gas valve being connected to one individual grid recesses, is that each grid recess 2705 is covered by an individual elastic substrate, which does not need to be shared by more than one grid recess 2705 In some embodiments, each individual substrate of an individual grid recess 2705 contracts during the pressure change created by the individual gas valve, enabling individual harvesting of separate ice blocks.

A potential advantage of an individual gas valve being connected to one individual grid recesses, is that each grid recess 2705 is covered by an individual elastic substrate, which therefore enables the geometry of the grid to allow vacancies between independent grid recesses. Such vacancies allow latent heat from the freezing process to escape the grid, therefore decreasing the time required for the freezing process to complete. Decreasing the freezing process time, inter alia, increases production rate of ice blocks by the ice maker.

Figures 27A, 27B:
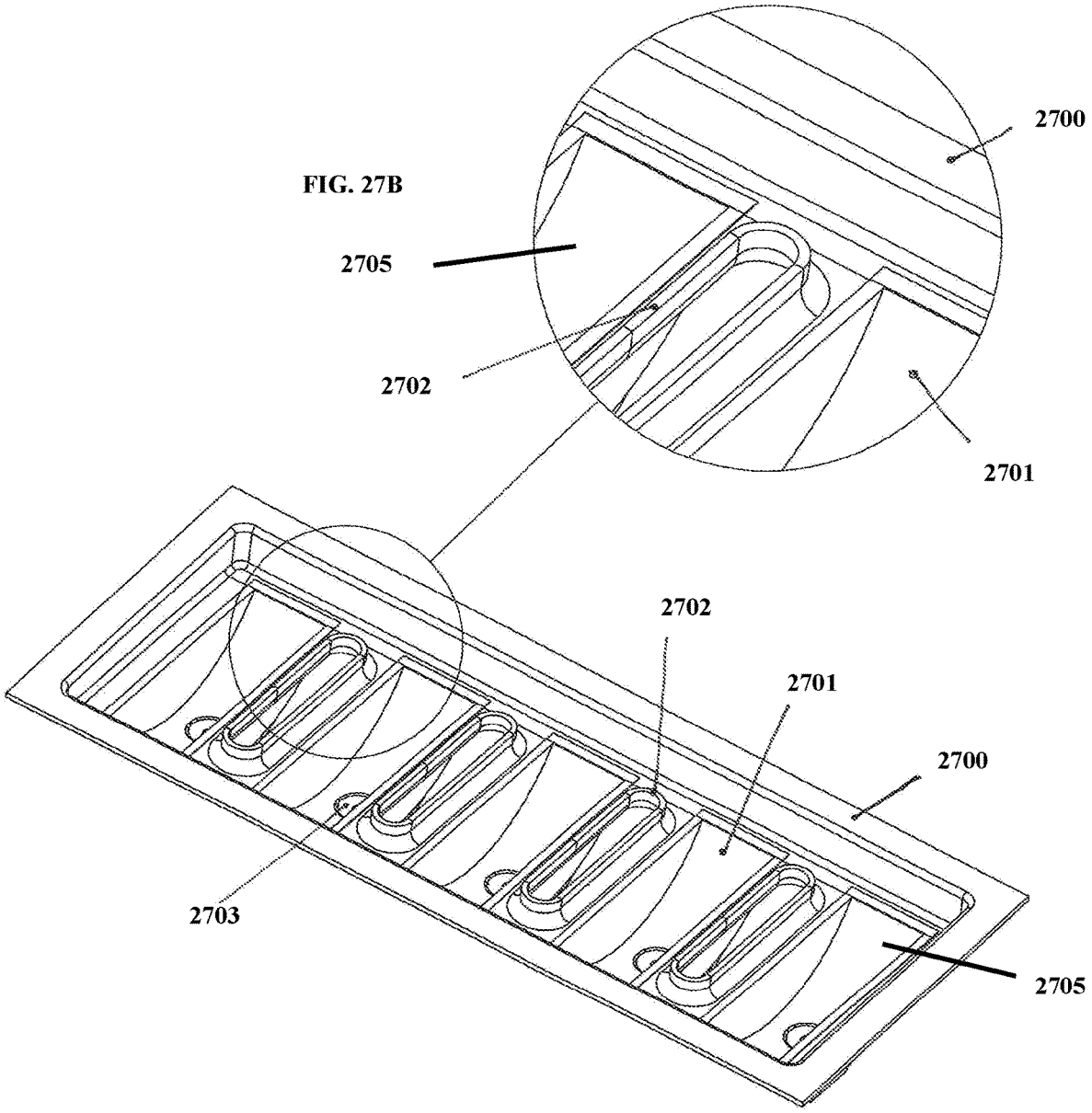
FIGS. 27A-27D are top view, detailed view, and bottom views simplified illustrations of an ice maker with dry harvesting in accordance with some embodiments of the invention.
Figure 27C:
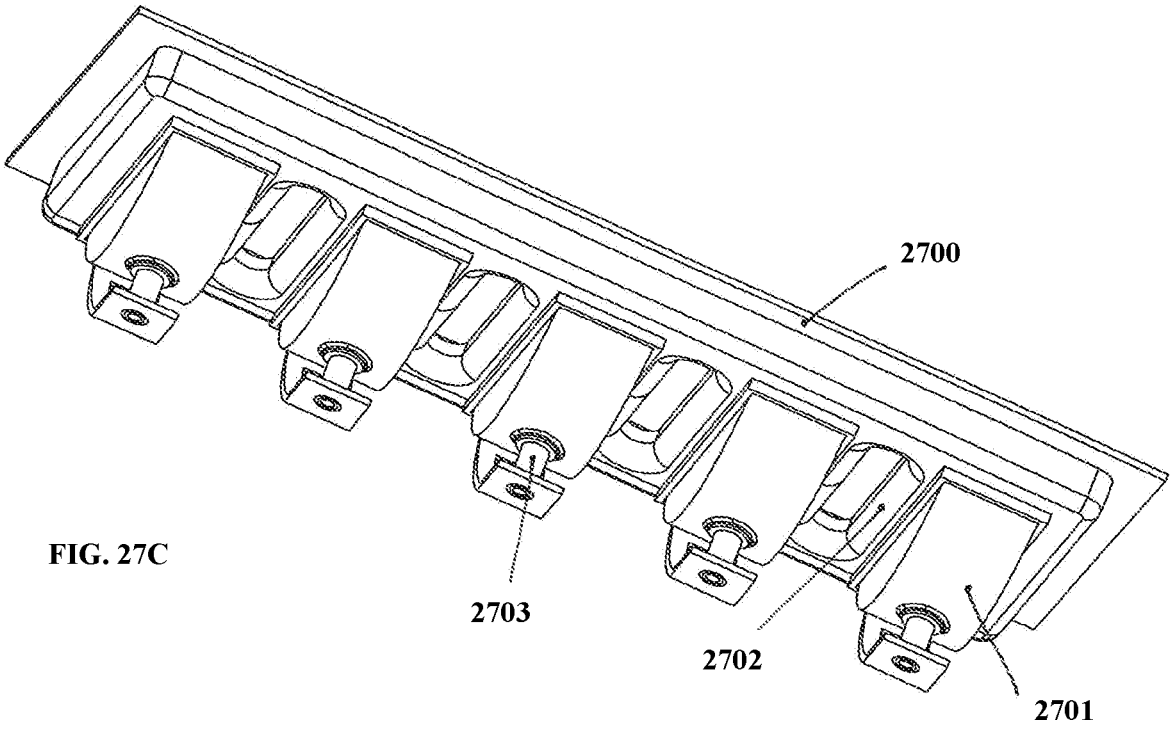
Figure 27D:
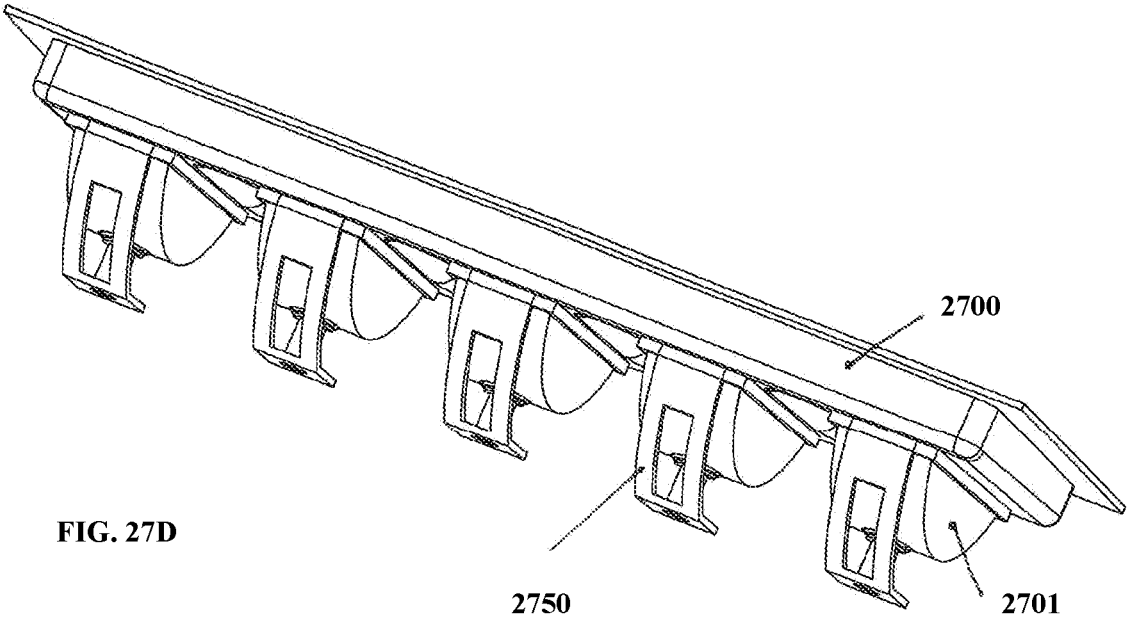

In some embodiments, such as depicted by FIG. 27C and FIG. 27D, one or more gas valves 2703 is connected to a gas valve bottom support 2750. In some embodiments, the gas valve bottom support 2750 has opening at the side, which can be used for the gas valve 2703 injection molding process. In some embodiments, the gas valve 2703 comprises an injection mold cavity, which is inserted through the square gas valve bottom support 2750 opening. Another way to assemble the gas valve 2703, is by plugging it into tray 2700, after the injection molding process.

Figure 28:
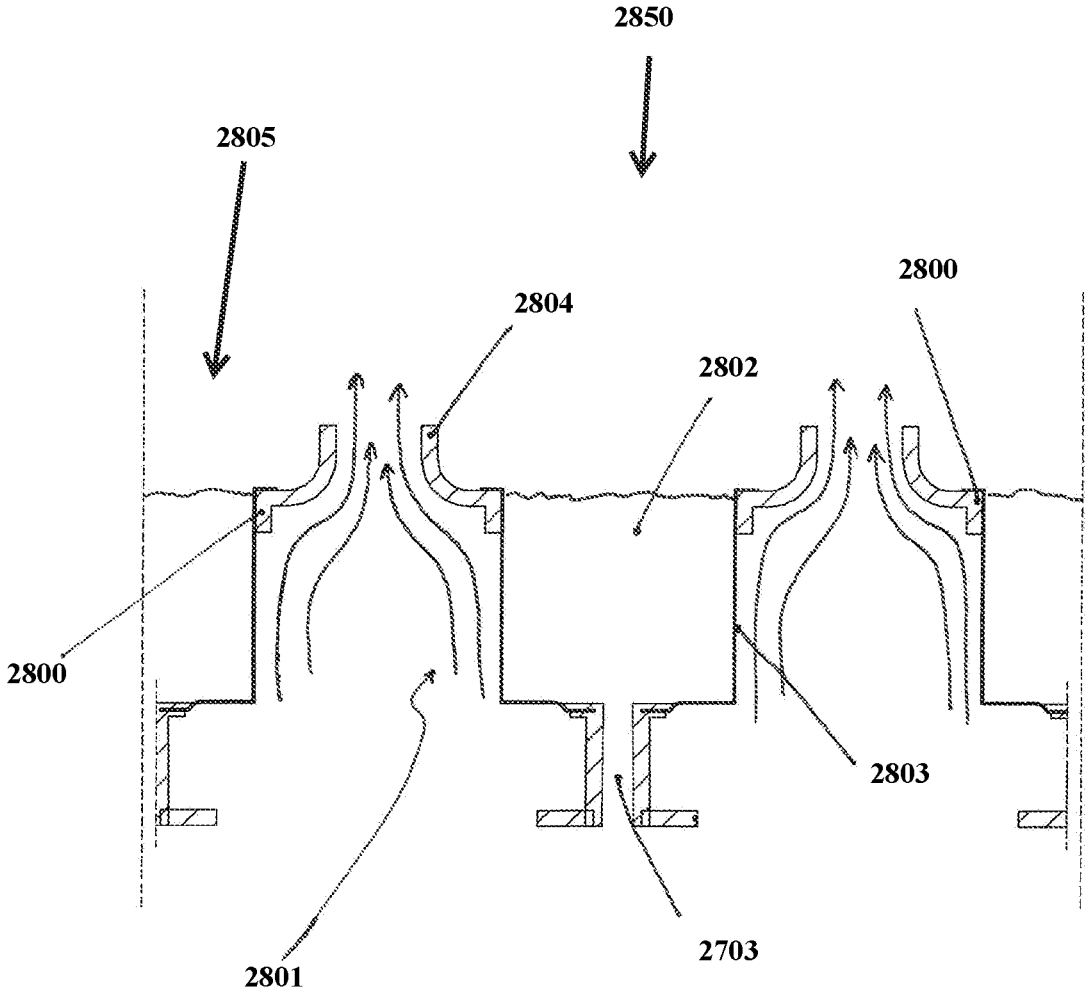
FIG. 28 are cross section diagrams of an ice maker with dry harvesting in accordance with some embodiments of the invention.

FIG. 28 are cross section diagrams of an ice maker with dry harvesting in accordance with some embodiments of the invention. In some embodiments, one or more cell is made from elastic substrate 2701 connected by soldering, brazing and/or fit press techniques, for example, to the tray 2700 creating rigid area of the elastic substrate 2800, which is used as an ice sealing mechanism during the dry harvesting process and for withdrawing heat from the water or ice during the freezing process, and conducting the heat all around the tray 2700.

For example, water 2802 is filling an ice grid recesses 2805 made from elastic substrate 2803, cooling down and releasing heat through the ice grid recesses 2805 made from elastic substrate 2803 side walls, heating the air 2801 that can flow upward through the conduit 2804. Heat is withdrawn and conducted as well from the water or ice using the rigid area of the elastic substrate 2800, through the tray 2850 to the air by convection. Another way to help the hot air flow from the bottom side of the tray 2850, is by tilting the tray 2850 and creating a slope for the hot air. Without the conduit 2804 or the tray 2850 tilting, the hot air flow upward is much slower, lowering the heat evacuation from the water and slowing the water freezing, and creating temperature gradient between the tray 2850 side and center.

Heat evacuation from ice grid recesses 2805 made from an elastic substrate 2803 varies from ice grid recess to recess because the external ice grid recesses freeze before, the inner ice grid recesses. To overcome this negative phenomenon, each conduit's 2804 width, length and height can be different, as well as the spacing of the ice grid recesses 2805 made from elastic substrate 2803, which enables the adjustment and control of the heat evacuation rate from the water, keeping the rate uniformed in all the ice grid recesses 2805 made from elastic substrate 2803.

The shape and the dimensions of the conduit 2804 can be in any form straight or round, etc. and can be adjusted to any ice cube dimension and shape.

The ice cubes ejection from the cells made from elastic substrate 2803, can be made with ejectors or by turning the tray 2850 upside down, using a pneumatic actuator, squeezing the bottom ice cells against ridge surface for example.

Figure 29A:
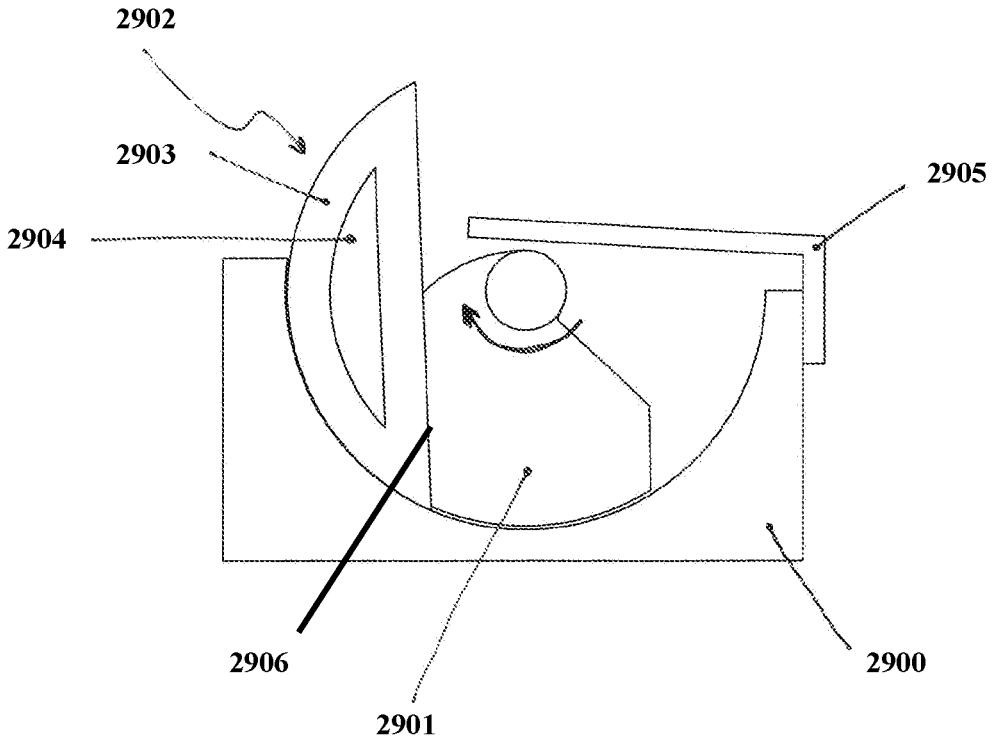
FIGS. 29A-29C are cross section simplified illustrations of an ice maker with dry harvesting during ice shell harvesting, during the freezing process, and after the freezing is completed in accordance with some embodiments of the invention.
Figure 29B:
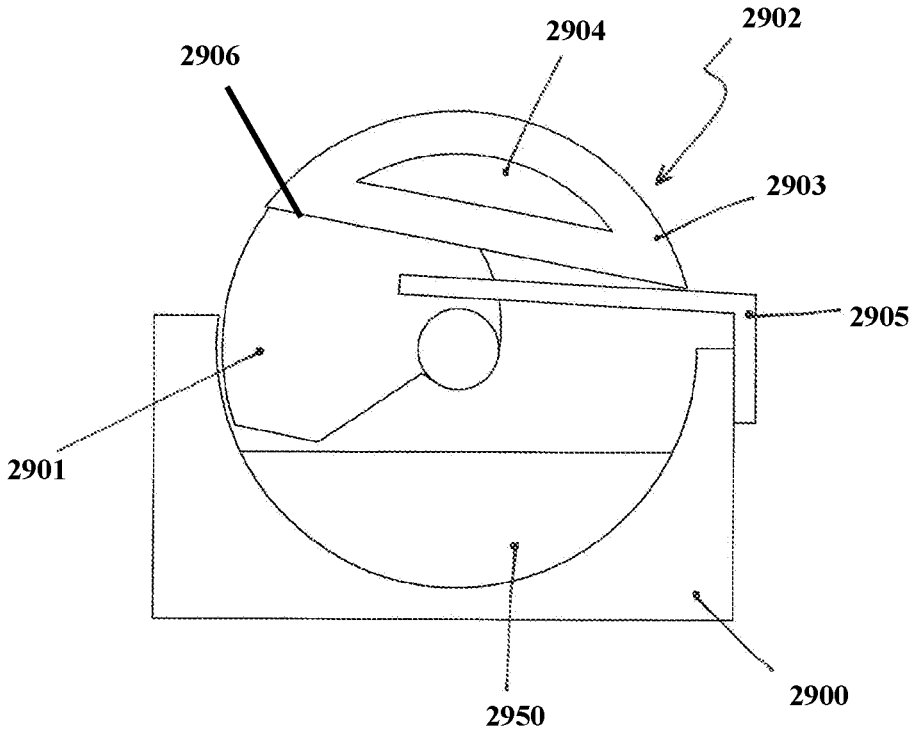
Figure 29C:
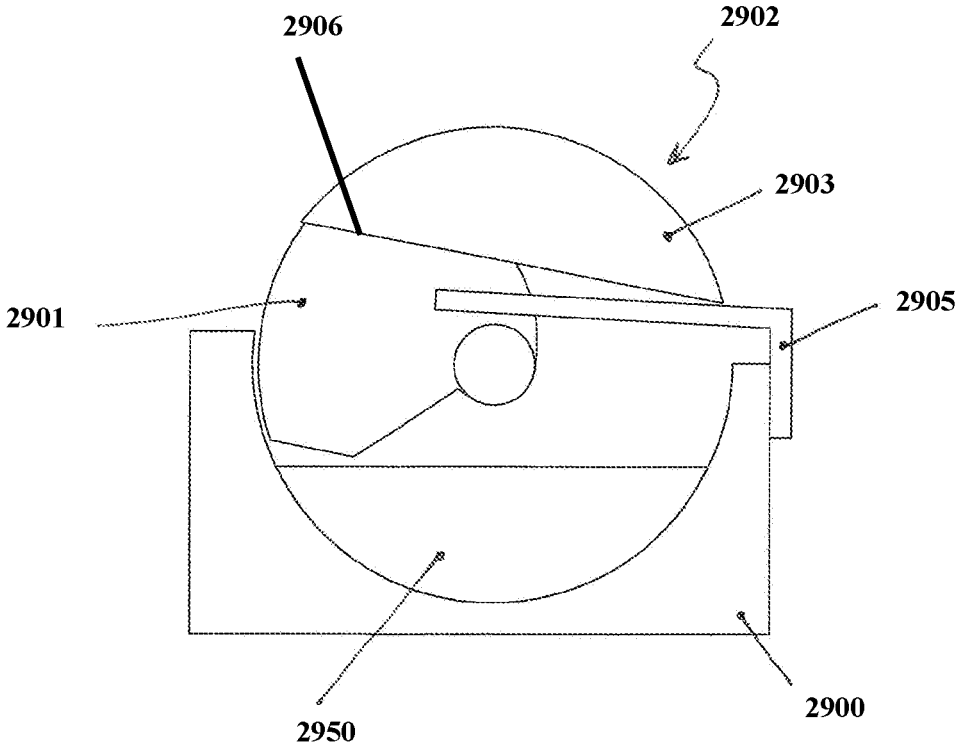

Reference is made to FIG. 29A-C, which are cross section simplified illustrations of an ice maker with dry harvesting during ice shell harvesting, during the freezing process, and after the freezing is completed in accordance with some embodiments of the invention. In some embodiments, the ice maker comprises an ejector 2901. In some embodiments, the ejector 2901 is configured to rotate inside the ice maker cell 2900, after the dry deicing process has completed. In some embodiments, ice maker cell 2900 comprises a concave surface. In some embodiments, ice forms inside the concave surface of the ice maker cell 2900. In some embodiments, the ejector 2901 is configured to rotate inside the ice maker cell 2900 before the ice cube freezes completely. In some embodiments, the ejector 2901 pushes the ice shell cube 2902 that is composed of an ice shell 2903 and unfrozen water 2904. In some embodiments, the ejector 2901 pushes a completely frozen ice cube. In some embodiments, the ejector 2901 pushes the ice cube onto a shelf 2905. In some embodiments, shelf 2905 comprises finger-like projections. In some embodiments and as shown in the exemplary embodiment depicted in FIG. 29C, at least a portion of ejector 2901 rotates in between two or more of the finger-like projections.

In some embodiments, the ejector 2901 comprises at least one ejecting end 2906. In some embodiments, the ejector 2901 comprises at least one ejecting end 2906 configured to accommodate a surface of an ice cube. in some embodiments, the ejecting end 2906 is an integral part of the ejector 2901. In some embodiments, the ejecting end 2906 is flat. In some embodiments, the ejector 2901 comprises at least one ejecting end 2906 configured to accommodate a surface of an ice shell cube 2702. In some embodiments, the ejecting end 2906 of the ejector 2901 covers a portion of the ice cube surface area, such that the rotation of the ejector 2901 pushes the ice cube without damaging the structure of the ice. In some embodiments, the ejector 2901 is made of semi-rigid materials. In some embodiments, the ejector 2901 is hollow.

In some embodiments, such as depicted by FIG. 29B, the ice shell cube 2902 is placed on the shelf 2905 for completing the freezing process. In some embodiments, after the ice shell cube 2902 is placed on the shelf 2905, the ejector 2901 remains stationary for the completion of the freezing process. In some embodiments, at the same time while the ice shell cube 2902 is completing the freezing process, fresh water 2950 fills ice maker cell 2900, and a new freezing cycle begins.

In some embodiments, the shelf 2905 provides temporary storage for ice cubes. In some embodiments, the shelf 2905 is coupled to the ice maker cell 2900. In some embodiments, the shelf 2905 is coupled to the outer wall of the ice maker cell 2900. In some embodiments, the shelf 2905 is an integral part of the ice maker cell 2900. In some embodiments, the shelf is made of a rigid material, such as aluminum or copper. In some embodiments, the length of the shelf is 1-10 cm. in some embodiments, the thickness of the shelf is 1-20 mm.

In some embodiments, such as depicted by FIG. 29C, the ice shell cube 2902 finishes the freezing process and the unfrozen water 2904 freezes and becomes an ice shell cube 2903. After the ice shell cube 2902 freezing process ends, the ejector can rotate again and pushes the ice cube down to the storage bin.

Figure 30A:
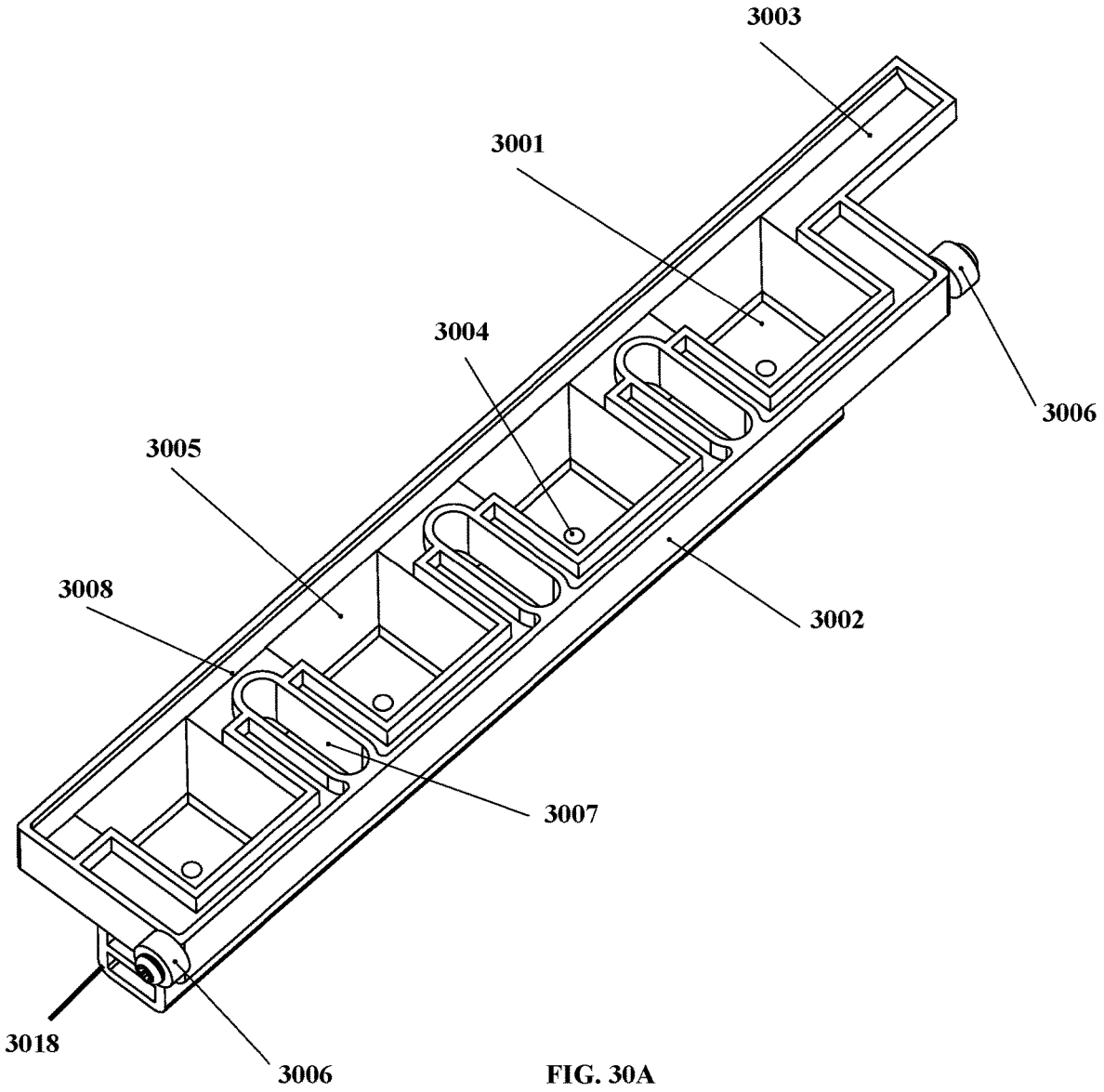
FIGS. 30A-30C are simplified side view illustrations of a grid having multiple gas valves for dry harvesting of ice without and with a lid in accordance with some embodiments of the invention.
Figure 30B:
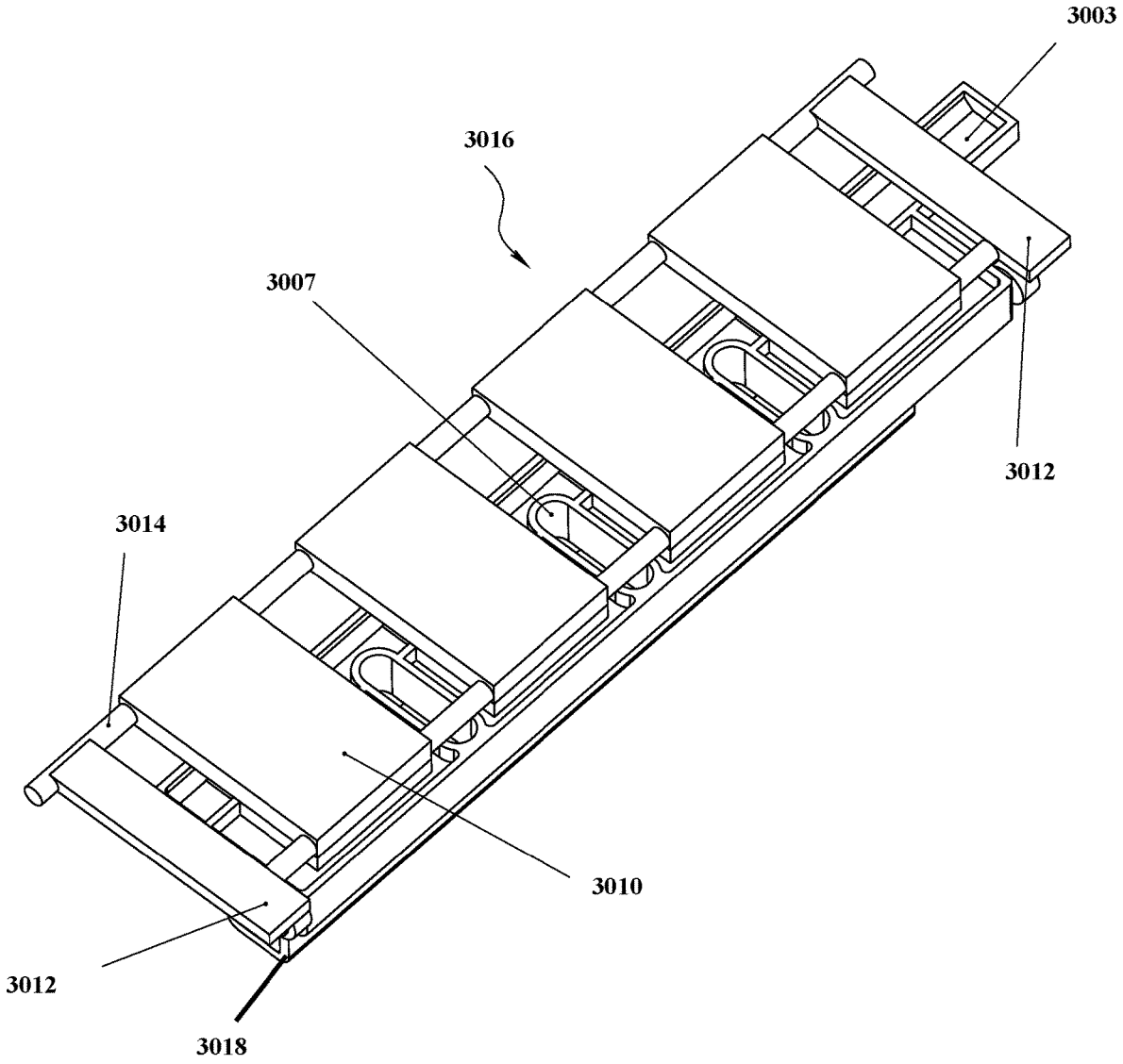
Figure 30C:
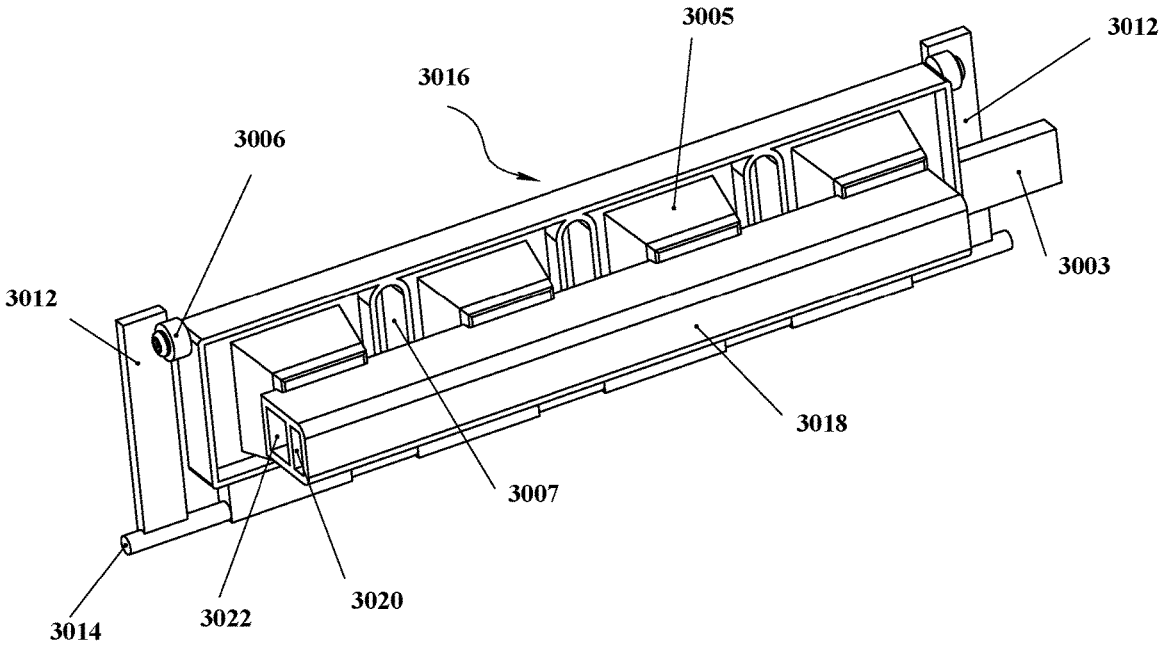

Reference is now made to FIG. 30A-C, which are simplified side view illustrations of a grid having multiple gas valves for dry harvesting of ice without and with a lid in accordance with some embodiments of the invention. In some embodiments, such as the embodiment depicted by FIG. 30A, a water channel 3008 is configured to supply water to the multiple grid recesses 3005. In some embodiments the water channels 3008 receive water from a water pouring sump 3003. In some embodiments, the water pouring sump 3003 is connected to a water source. In some embodiments, a flange 3002 surrounds the water channel 3008. In some embodiments, the ice maker comprises water distribution channels 3008 between the grid recesses 3005, which allow water to flow from one grid recess 3005 to another.

In some embodiments, a conduit 3007 draws heat away from the water to form the ice cubes in the grid. In some embodiments, once water is supplied to the grid recesses 3005 ice begins to form. In some embodiments, the ice can be dry harvested. In some embodiments, the ice maker comprises a plug for the gas valve 3004. In some embodiments, a plug 3024 for the gas valve 3004 allows (a) breaking the vacuum at the grid recesses 3005 bottom and/or (b) flow air under the elastic substrate 3001.

In some embodiments, the plug 3024 prevents water from entering the pneumatic system during water pouring and freezing. In some embodiments, the plug 3024 enables gas to flow through it during the dry harvesting stage. In some embodiments, the ice maker comprises a tilt axis set by at least one wheel 3006, pin and/or axle. At least one wheel 3006 is attached to the outside of the flange 3002. In some embodiments, dry harvesting of ice is implemented by tilting the ice maker about the tilt axis set by at least one wheel 3006.

In some embodiments, the center of at least one wheel 3006 is a rotation axis of the grid. In some embodiments, the center of at least one wheel 3006 is a rotation axis of a lid 3010. In some embodiments, at least one wheel 3006 is lined across one edge of the grid. In some embodiments, the diameter of the wheel 3006 ranges between 1-10 cm. In some embodiments, the wheel 3006 is a gear.

In some embodiments, the range of rotation is between 0 and 180 degrees. In some embodiments, the range of rotation is between 30 and 150 degrees. In some embodiments, the range of rotation is between 45 and 90 degrees. In some embodiments, the range of motion of the rotation axis is at least 8 degrees.

In some embodiments, and in the embodiment depicted by FIG. 30B, the ice grid 3016 comprises at least one lid 3010. In some embodiments, each lid 3010 covers an grid recess 3005. In some embodiments, the lid 3010 is connected unilaterally to an axis 3014. In some embodiments, the lid 3010 is connected on the opposite side of the grid recess 3005 from the tilt axis of wheel 3006. In some embodiments, the lid 3010 is fixed while the ice maker axle 3014 is lined across one edge of the grid.

In some embodiments, the ice maker comprises one or more lids 3010. In some embodiments, the lids 3010 cover a portion of the grid recesses 3005. In some embodiments, the lids 3010 cover all the grid recesses 3005. In some embodiments, each lid 3010 covers one grid recess 3005. In some embodiments, each lid 3010 covers a plurality of grid recesses 3005. In some embodiments, the lids 3010 are joint at the mutual axis 3014. In some embodiments, the lids 3010 do not cover the conduits 3007. In some embodiments, the lid 3010 is a fitted to the grid. In some embodiments, the lid 3010 is configured to seal the grid. The lid 3010 can be composed of materials with low thermal conductivity, for example, cellular glass, closed-cell phenolic, flexible elastomeric, polyisocyanurate, polystyrene. In some embodiments, the thickness of the isolation material ranges between 1 mm to 3 cm. In some embodiments, during the freezing process, the lid 3010 insulates the top surface of the water, which can reduce its heat evacuation.

A potential advantage of the isolation of the water using the lid 3010 is that the water surface center freezes last, which allows water outgassing and/or water expansion during the water phase change, to flow through the center of the top surface until the freezing process ends. An open path for water and outgassing to expand upward during the freezing process allows the formation of ice blocks with high compressive strength. An open path for water and outgassing to expand upward during the freezing process also prevents the formation of internal stress within the ice block and/or cracks and/or defects within the ice block, which helps keep the ice block whole in the storage bin and though the dispensing system. The dispensing system often breaks the ice blocks, therefor crystal defects which weaken the ice blocks are unwanted. Furthermore, preventing such crystal defects from forming in the ice blocks create translucent ice blocks, which melt without acoustic emission.

In some embodiments, and in the embodiment depicted by FIG. 30C, one gas valve channel 3018 is joint to more than one of the grid recesses 3005. In some embodiments, one gas valve channel 3018 provides gas to all of the grid recesses 3005. In some embodiments, each grid recess 3005 has at least one contact point with the gas valve channel 3018. In some embodiments, before an ice batch is started, gas enters at least one gas valve sealing channel 3022. In some embodiments, the gas in the gas valve sealing channel 3022 urges the valve cushion 3104 (FIG. 31B) against plugs 3024, and in some embodiments, it prevents water from entering the pneumatic system from the grid recess 3005, before, during, and/or after the water pouring process and/or water freezing process. In some embodiments, during dry harvesting, the separation of the ice is propagated throughout the evaporator grid by the compressed gas from one gas valve harvesting channel 3020, as shown in one embodiment depicted by FIG. 31A-B, which are cross section diagrams of a grid with multiple gas valves for dry harvesting of ice in accordance with some embodiments of the invention.

In some embodiments, the gas valve harvesting channel 3020 and/or the gas valve sealing channel 3022 are composed of semi-flexible materials. In some embodiments, the gas valve harvesting channel 3020 and/or the gas valve sealing channel 3022 are used to dry harvest ice blocks from the grid recesses 3005. In some embodiments, the space inside the gas valve harvesting channel 3020 and/or the gas valve sealing channel 3022 expands during the flow of gas from the gas source to the ice machine. In some embodiments, the expansion of the gas valve sealing channel 3022 applies positive pressure onto the surfaces of the grid recesses 3005 that are adjacent to the gas valve sealing channel 3022. In some embodiments, applying a positive pressure onto the surface of the grid recess 3005 that are adjacent to the gas valve sealing channel 3022 gradually deices the ice blocks from the elastic substrate.

Figure 31A:
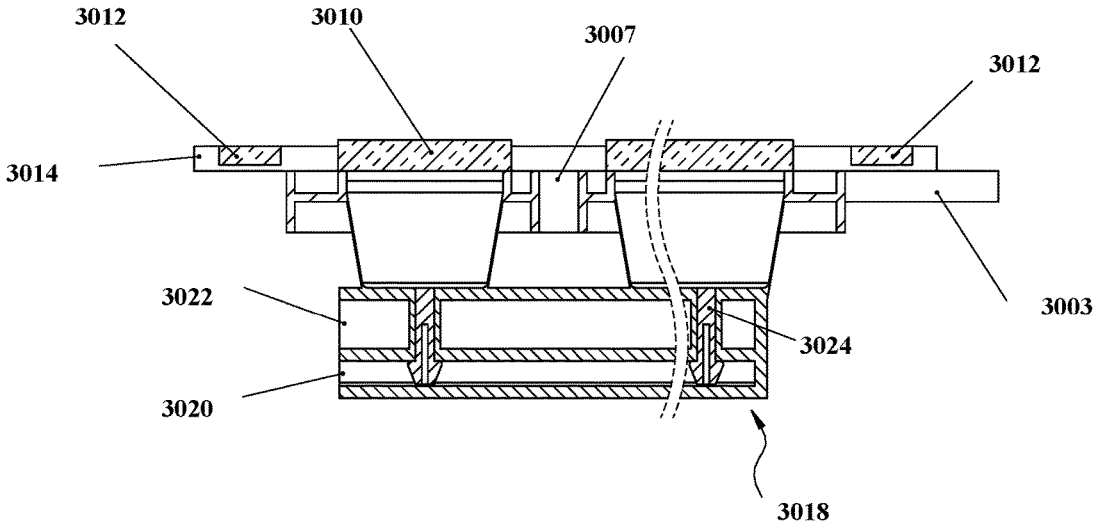
FIGS. 31A-B are cross section diagrams of a grid with multiple gas valves for dry harvesting of ice in accordance with some embodiments of the invention.
Figure 31B:
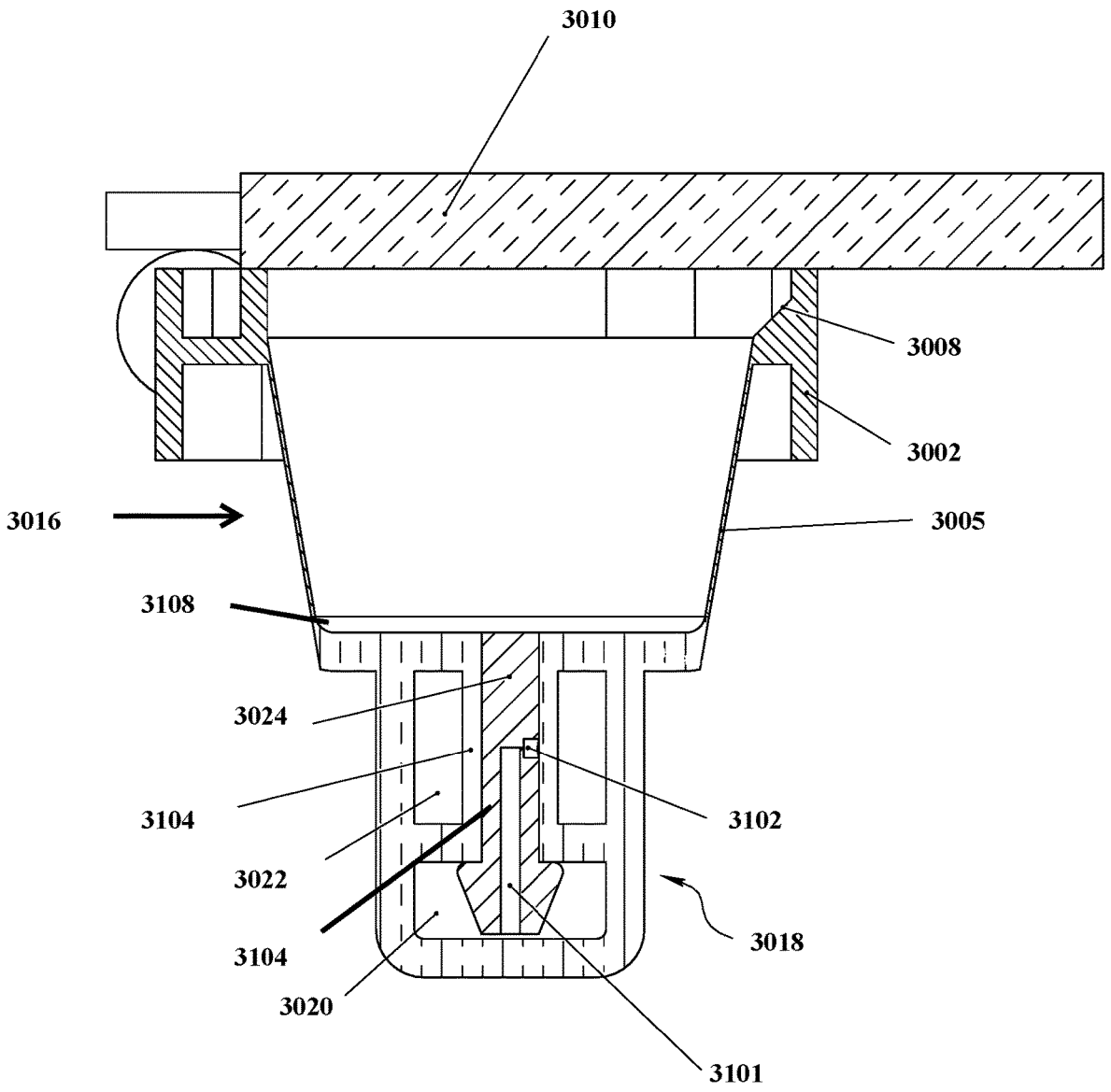

Reference is now made to FIGS. 31A and 31B which are cross section diagrams of a grid with multiple gas valves for dry harvesting of ice in accordance with some embodiments of the invention. The grid comprises a water pouring sump 3003 to allow water access into the grid, and conduits 3007 for removal of heat from the water. The grid comprises lids 3010 connected unilaterally to an axis 3014, which can be tilted to disengage the lid 3010 from the grid.

In some embodiments, such as depicted in FIG. 31B, the gas valve is compressed. During the separation stage, the plug gas channel 3101 allows gas to flow from the one gas valve harvesting channel 3020 and into orifice 3102, which in some embodiments limits the air flow during the dry harvesting process, which can keep the pressure inside the one gas valve harvesting channel 3020 from dropping after harvesting the first ice block. In some embodiments, the valve cushion 3104 expands into the one gas valve sealing channel 3022 when gas flow pressure is higher than the pressure in the one gas valve sealing channel 3022, thus allowing compressed gas to pass the grid floor 3108 and between the ice cube and the elastic substrate 3001. In some embodiments, when the pressure in the gas valve sealing channel 3022 is greater than the pressure that is applied to valve cushion 3104 from the gas flowing from orifice 3102, then the valve cushion 3104 adheres onto plug 3024, which seals the grid from the gas valve channel 3018.

Figure 32A:
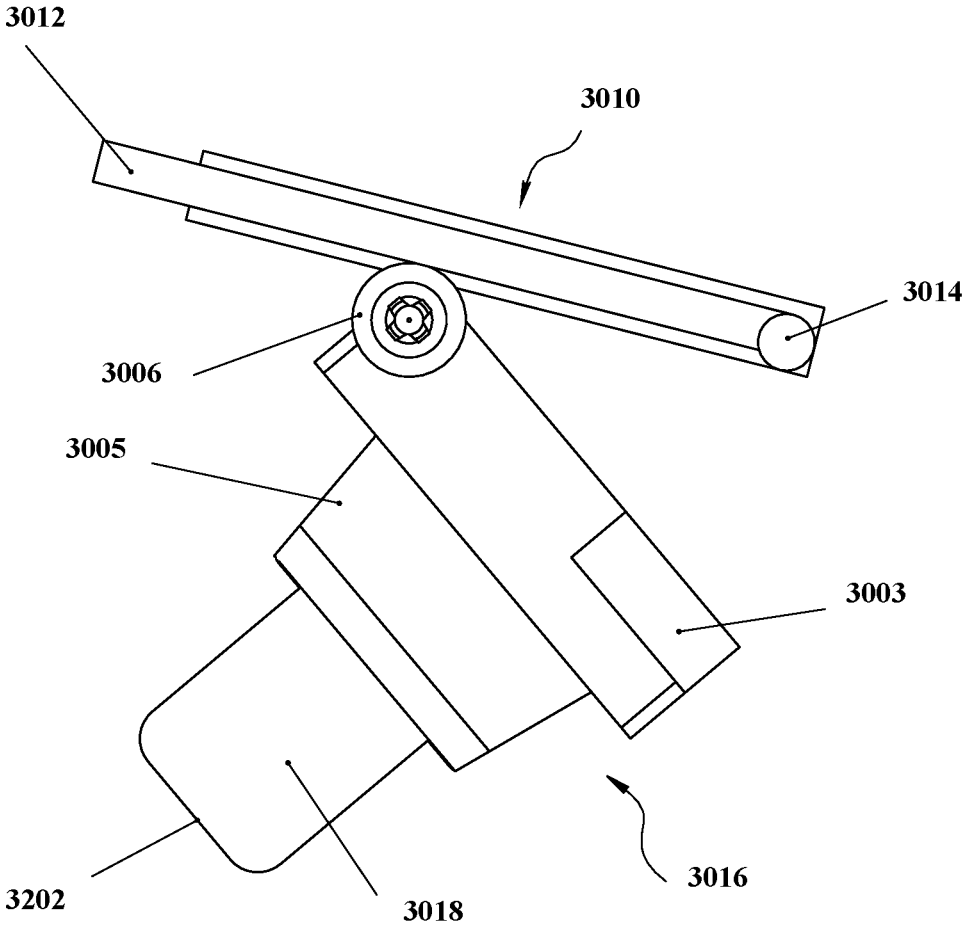
FIGS. 32A-C are a side view and a cross section view schematic illustrations of a grid having a tilt axis for dry harvesting of ice in accordance with some embodiments of the invention.
Figure 32B:
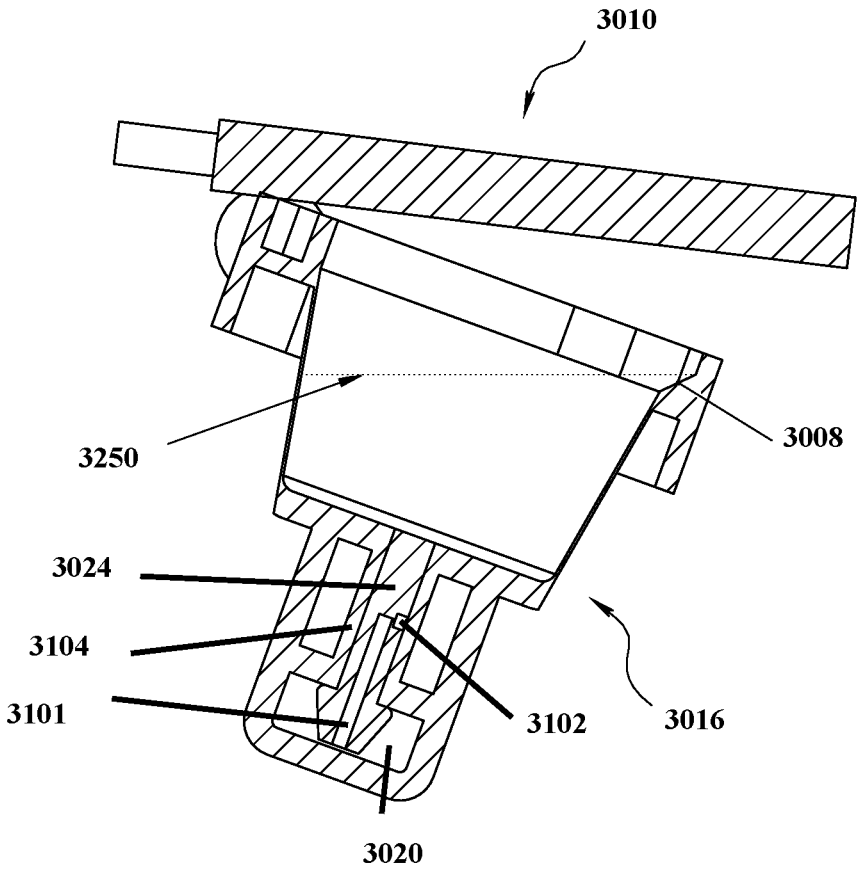
Figure 32C:
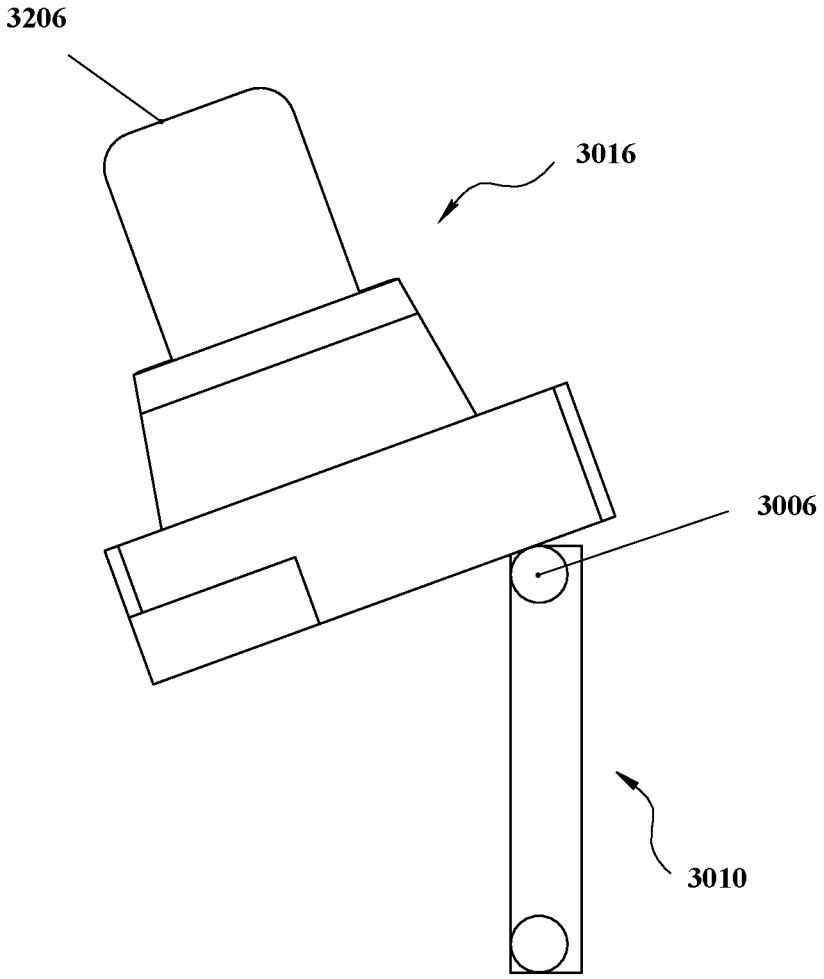

Reference is now made to FIG. 32A-C, which are a side view and a cross section view schematic illustrations of a grid having a tilt axis for dry harvesting of ice in accordance with some embodiments of the invention. In some embodiments, the lid 3010 slides on a rail 3012. In some embodiments, the rail 3012 is connected to at least one side of the lid 3010. In some embodiments, the rail 3012 is connected to the wheel 3006. In some embodiments, the rail 3012 glides on the wheel 3006. In some embodiments, the grid and/or lid 3010 can rotate in relation to each other about the axis of rotation of wheel 3006 and/or glide on the rail 3012.

In some embodiments, the lid 3010 is fixed. In some embodiments, during the separation stage, any change in position, for example the rotation of the grid in relation to the lid 3010 or the ice maker housing, knocks or otherwise exerts a force upon a surrounding structure of the grid. In some embodiments, the force is applied onto the back of the grid 3202 or/and the grid floor 3108, which allows mechanical ejection of the ice from the grid, whereby the ice is separated from the grid, and/or pushed by the exerted force, to leave the ice grid 3016, or/and to finish separated the ice from the grid and allowing mechanical ejection.

The embodiment depicted by FIG. 32B shows a grid having a tilt axis for dry harvesting of ice during a water pouring stage. In some embodiments, water is supplied by a water source into the water pouring sump 3003. In some embodiments, the water is distributed between the grid recesses 3005. In some embodiments, water is distributed into the grid recesses 3005 by rotating the grid in relation to the lid 3010, about the axis of rotation of wheel 3006.

In some embodiments, the water level 3250 raises with respect to water channel 3008, allowing water to flow in water channel 3008 and to distribute between the grid recesses 3005. In some embodiments, after the water pouring process ends, the ice grid 3016 is set back to horizontal position, lowering the water level 3250 with respect to water channel 3008. In some embodiments, the water channel 3008 is then emptied from water, which prevents ice from freezing in the water channel 3008.

A potential advantage of the ability to tilt the ice grid 3016 is in that the prevention of water freezing in the water channels 3008 prevents the formation of ice bridges between two individual ice blocks.

The embodiment depicted in FIG. 32C shows a grid having a tilt axis for dry harvesting of ice during tilting. In some embodiments, the ice cubes are separated from the grid and/or lid 3010 by rotating the grid and/or lid 3010 in relation to each other about an axis of rotation of the wheel 3006. Any change in relative position of the grid, for example the rotation of the grid in relation to the lid 3010, can knock or otherwise exert force upon a surrounding structure of the grid. In some embodiments, the exerted force is applied onto the back of the ice grid 3016. In some embodiments, the exerted force is applied onto the back of the grid 3206 by knocking on the back of the ice grid 3016. In some embodiments, the exerted force which is applied onto the back of the ice grid 3016 allows mechanical ejection of the ice from the ice grid 3016. In some embodiments, the ice is separated from the ice grid 3016, and/or pushed by the exerted force, to leave the ice grid 3016.

Water Channels

In some embodiments, the water channel 3008 is round, and in some embodiments, it is flat with rectangular walls. In some embodiments, the depth of the water channel 3008 ranges between 1 cm to 40 cm. In some embodiments, the water channel 3008 collects water in case of double filling. In some embodiments, the length of a water channel 3008 ranges between 5-40 mm. in some embodiments, the width of the water channel 3008 ranges between 1-5 mm. In some embodiments, the depth of the water channel fluctuates. In some embodiments, the water channel 3008 is configured to allow laminar water flow.

In some embodiments, the water channel 3008 is configured to allow turbulent water flow. The water pouring sump 3003 can have similar depth as the water channel 3008. In some embodiments, the depth of the pouring sump 3003 ranges between 1-40 cm. In some embodiments, the length of the pouring sump 3003 ranges between 5-100 mm. In some embodiments, the width of the pouring sump 3003 ranges between 1-5 mm.

A potential advantage of the water channels is that the flowing water is directed into the grid recess such that no water is spilled, therefore no water is wasted, and no excess ice is formed in areas other than the grid recess.

A potential advantage of the water channels is that the rate of water flow in the water channel can be controlled using a controller, which can be connected to a valve at the water source. The controller can also control the tilting axis of the ice maker from and back to a horizontal position, which allow for rate of water flow restriction and allowance with respect to the tilting angle of the water channels.

A potential advantage of emptying water channels is that it enables the production of separate ice cubes without ice bridges between them. The ice bridges between ice cubes break during harvesting and dispensing, which increases the power that is needed for harvesting the ice cubes. The ice bridges between ice cubes also damage the visibility and quality of the ice cubes.

A potential advantage of emptying water channels 3008 is that small ice fractures do not end up in the storage bin. These fractures which pile in the storage bin can reach up to 10% of the total ice volume, therefore the. The prevention of the ice bridges increases the amount of ice that can be dispensed by the prevention of ice fractures that get stuck in the storage bin.

Conduits

In some embodiments, the conduit 3007 is shared between two recesses in the grid. In some embodiments, the walls of the conduit 3007 are composed of materials with high thermal conductivity. In some embodiments, the shape of the conduit 3007 varies, for example, rectangular, circular, or oval. In some embodiments, the surface area of the flange 3002 walls is 1-20 squared mm. In some embodiments, the volume inside a flange 3002 is 5-250 ml.

A potential advantage of the conduits is that latent heat released in the freezing process can be evacuated away from the grid, therefor decreasing the time required for the freezing process of the ice blocks, which contributes to the increase in production rate of ice blocks. In some embodiments, the conduits 3007, along with other aspects of the ice make as described in greater detail elsewhere herein, provide an increase in production rate of 10% to 15% in comparison to common ice machines.

In some embodiments, there is provided a method for making ice in an angled ice maker. In some embodiments, the method comprises angling an ice maker. In some embodiments, the method comprises closing the lid on the evaporation grid. In some embodiments, the method comprises filling the evaporation grid with water. In some embodiments, the water flows into the evaporation grid from the water source through the water channels.

In some embodiments of the invention, there is provided a method for ejecting ice from an ice maker comprising inserting high-pressure gas into a gas valve connected to an evaporator grid, where the high-pressure gas is at a pressure at least 0.1 bar above ambient pressure. In some embodiments, the method comprises initiating separation between an ice block and an elastic substrate in a region surrounding the gas valve by mechanical manipulation of an outlet notch of the gas valve, where the elastic substrate is disposed over the evaporator grid. In some embodiments, the method comprises separation between the ice block and the elastic substrate by contraction of the elastic substrate towards the metallic base until most of the ice block is separated from the elastic substrate.

In some embodiments, the method comprises tilting the evaporator grid to allow mechanical ejection of the ice from the grid. In some embodiments, the method comprises applying a force on the back of the evaporator grid to allow mechanical ejection of the ice from the grid. In some embodiments, the method comprises tilting the evaporator grid onto a substrate which blocks further rotation of the evaporator grid. In some embodiments, the method comprises tilting the evaporator grid onto a substrate which blocks further rotation of the evaporator grid results in an exerted force upon the evaporator grid which allows mechanical ejection of the ice from the grid.

In some embodiments, there is provided a method for ejecting ice from an ice maker. In some embodiments, the method comprises flowing gas though the gas valve harvesting channel 3020. In some embodiments, the method comprises flowing gas though the gas valve sealing channel 3022. In some embodiments, the method comprises expanding the gas valve harvesting channel 3020. In some embodiments, the method comprises expanding the gas valve harvesting channel 3020 using the flowing gas. In some embodiments, the method comprises expanding the gas valve sealing channel 3022.

In some embodiments, the method comprises expanding the gas valve sealing channel 3022 using the flowing gas. In some embodiments, the method comprises applying positive pressure onto the surfaces of the grid recesses 3005. In some embodiments, the method comprises applying positive pressure onto the surfaces of the grid recesses 3005 which are adjacent to the gas valve sealing channel 3022. In some embodiments, the method comprises gradually deicing the ice blocks from the elastic substrate. In some embodiments, the method comprises gradually deicing the ice blocks from the elastic substrate using the positive pressure which is applied onto the surfaces of the grid recesses 3005.

In some embodiments of the invention, there is provided a method for distributing water. In some embodiments, the method comprises flowing water from a water source and into a grid recess using a water channel. In some embodiments, the method comprises tilting the grid to increase water flow. In some embodiments, the method comprises tilting the grid to decrease water flow.

In some embodiments of the invention, there is provided a method for ejecting ice using a rotating ejector 2901. In some embodiments, the ejector 2901 is a barrier for the ice cubes. In some embodiments, the ejector 2901 comprises at least one flat surface. In some embodiments, a surface of the ejector 2901 comes in contact with the ice block. In some embodiments, the ejector 2901 rotates about an axis of rotation. In some embodiments, the method comprises placing an ejector 2901 onto a portion of an ice block. In some embodiments, the method comprises pushing the ice block by rotation of the ejector 2901 about an axis of rotation. In some embodiments, the method comprises allowing the ice block to leave the grid. In some embodiments, the method comprises pushing the ice block onto a shelf 2905.

The invention claimed is:

1. An ice maker, comprising:

an elastic substrate comprising one or more recesses, wherein each of said one or more recesses is configured for the formation of an ice block, and wherein said elastic substrate is disposed over an evaporator grid;

a pressure source configured to provide a fluid; and at least one fluid valve in fluid communication with said pressure source and at least one of said one or more recesses, and configured to release a flow of said fluid between said elastic substrate and said ice block formed within said recess, wherein at least a portion of said elastic substrate is configured to deform and separate from said ice block by said flow of fluid, to allow said fluid to pass between said elastic substrate and said ice block, thereby initiating a separation between said elastic substrate and said ice block.

2. The ice maker according to claim 1, wherein said pressure source is configured to provide a gas.

3. The ice maker according to claim 1, wherein at least one of the one or more recesses is in fluid communication with a water source via a water channel.

4. The ice maker according to claim 1, comprising a said fluid valve corresponding to each of said one or more recesses.

5. The ice maker according to claim 1, wherein the grid comprises at least one conduit in communication with the grid recesses and configured to evacuate latent heat released during the freezing process.

6. The ice maker according to claim 1, wherein the ice maker comprises at least one wheel moveably coupled to the grid and having an axis of rotation in respect to the grid such that rotation of the wheel changes the spatial orientation of the ice block in reference to the grid.

7. The ice maker according to claim 6, wherein the range of motion of the rotation axis is at least 8 degrees.

8. The ice maker according to claim 1, wherein the grid comprises an axis of rotation and is configured to rotate about the axis of rotation.

9. The ice maker according to claim 1, wherein the ice maker comprises an ejector which applies an ejecting force on an ice block during the harvesting of the ice block.

10. The ice maker according to claim 6 and comprising an ejector and wherein said ejector is rotated about the axis of rotation along a path of travel an engages an ice block interfering with said path of travel.

11. The ice maker according to claim 1, wherein the ice maker comprises at least one lid which covers at least a portion of the grid.

12. The ice maker according to claim 11, wherein the lid covers the grid recesses in which ice blocks are formed.

13. The ice maker according to claim 11, wherein the grid recesses in which ice blocks are formed, during the freezing process, are sealed by the grid and the lid.

14. A method comprising:

providing an ice make comprising:

an elastic substrate comprising one or more recesses, wherein each of said one or more recesses is configured for the formation of an ice block, and wherein said elastic substrate is disposed over an evaporator grid; and at least one fluid valve in fluid communication with at least one of said one or more recesses and configured to release a flow of fluid between said elastic substrate and said ice block formed within said recess, wherein at least a portion of said elastic substrate is configured to deform and separate from said ice block by said flow of fluid, to allow said fluid to pass between said elastic substrate and said ice block;

filling each of said one or more recesses with water;

removing heat from the water to form an ice block in each of said one or more recesses; and releasing a flow of fluid from said at least one fluid valve into at least one of said one or more recesses, to cause said at least a portion of said elastic substrate to deform and separate from said ice block, to allow said fluid to pass between said elastic substrate and said ice block and to initiate a separation between said substrate and said formed ice block.

15. The method of claim 14, wherein said ice maker comprises a said fluid valve corresponding to each of said one or more recesses.

16. The ice maker according to claim 1, wherein said at least a portion of said elastic substrate comprises a flexible region surrounding said valve which is configured to deform upon said release of said flow of said fluid.

17. The method of claim 14, wherein said at least a portion of said elastic substrate comprises a flexible region surrounding said valve which is configured to deform upon said release of said flow of said fluid.

* * * * *